US011408679B2

(12) United States Patent
Ohnari et al.

(10) Patent No.: US 11,408,679 B2
(45) Date of Patent: Aug. 9, 2022

(54) SHOE DRYER AND CONTROL METHOD THEREOF

(71) Applicant: Samsung Electronics Co., Ltd., Suwon-si (KR)

(72) Inventors: Hiroto Ohnari, Yokohama (JP); Daisuke Fukuoka, Yokohama (JP); Kazutoshi Takenoshita, Yokohama (JP); Suguru Nakagawa, Yokohama (JP); Toshiyuki Fujiyoshi, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 70 days.

(21) Appl. No.: 17/015,990

(22) Filed: Sep. 9, 2020

(65) Prior Publication Data

US 2021/0071950 A1 Mar. 11, 2021

(30) Foreign Application Priority Data

Sep. 10, 2019 (JP) ..... JP2019-164911
Jul. 28, 2020 (KR) ..... 10-2020-0094017

(51) Int. Cl.
*F26B 21/06* (2006.01)
*F26B 3/04* (2006.01)
(Continued)

(52) U.S. Cl.
CPC ..... *F26B 21/06* (2013.01); *F26B 3/04* (2013.01); *F26B 11/00* (2013.01); *F26B 21/001* (2013.01);
(Continued)

(58) Field of Classification Search
CPC .. F26B 21/06; F26B 3/04; F26B 11/00; F26B 21/001; F26B 21/10; F26B 21/12; F26B 25/008
(Continued)

(56) References Cited

U.S. PATENT DOCUMENTS 3,203,112 A * 8/1965 Edmonds ..... A47L 23/205 34/104
5,257,467 A * 11/1993 White ..... F26B 21/008 248/316.4
(Continued)

FOREIGN PATENT DOCUMENTS

CN 106724108 A 5/2017
CN 108095348 A 6/2018
(Continued)

OTHER PUBLICATIONS

International Search Report dated Jan. 8, 2021 in connection with International Patent Application No. PCT/KR2020/012104, 3 pages.
(Continued)

*Primary Examiner* — Stephen M Gravini

(57) ABSTRACT

A shoe dryer including a main body, a shoe receiver provided inside the main body and configured to receive a shoe, a blower configured to blow air toward the shoe received in the shoe receiving portion, a camera configured to obtain an image of the shoe by photographing the shoe received in the shoe receiver, and a control device configured to recognize information about the shoe from the image of the shoe obtained by the camera, and control a direction of air blown by the blower based on the information about the shoe.

20 Claims, 43 Drawing Sheets

(51) Int. Cl.

| | |
|---|---|
| ***F26B 11/00*** | (2006.01) |
| ***F26B 25/00*** | (2006.01) |
| ***F26B 21/10*** | (2006.01) |
| ***F26B 21/12*** | (2006.01) |
| ***F26B 21/00*** | (2006.01) |

(52) U.S. Cl.
CPC ..... *F26B 21/10* (2013.01); *F26B 21/12* (2013.01); *F26B 25/008* (2013.01)

(58) Field of Classification Search
USPC ..... 34/520
See application file for complete search history.

(56) References Cited

U.S. PATENT DOCUMENTS

| | | | | |
|---|---|---|---|---|
| 5,755,040 | A * | 5/1998 | Ou | D06F 58/10 34/202 |
| 7,430,816 | B1 * | 10/2008 | Lozenski | A47L 23/205 34/104 |
| 7,913,419 | B2 * | 3/2011 | Tomasi | D06F 29/00 34/595 |
| 8,186,075 | B2 * | 5/2012 | Beckett | A47L 23/205 34/106 |
| 8,381,413 | B2 * | 2/2013 | Smith | F26B 25/08 34/239 |
| 8,567,088 | B2 * | 10/2013 | Tritz | A01L 11/00 34/201 |
| 8,836,989 | B2 * | 9/2014 | Kim | G06F 9/4401 358/1.16 |
| 8,955,233 | B2 * | 2/2015 | Dean | F26B 5/12 34/90 |
| 8,955,234 | B2 * | 2/2015 | Williams | F26B 21/001 34/105 |
| 8,991,067 | B2 * | 3/2015 | Zielinski | F26B 5/04 34/403 |
| 9,031,400 | B2 * | 5/2015 | Bae | G03B 17/02 396/198 |
| 9,464,843 | B2 * | 10/2016 | Karafinka | A47L 23/205 |
| 10,197,332 | B2 * | 2/2019 | Hinkey | F26B 3/02 |
| 10,238,268 | B2 * | 3/2019 | Nurlybekov | A47L 23/205 |
| 10,520,253 | B2 * | 12/2019 | Mallory | F26B 15/16 |
| 10,687,597 | B2 * | 6/2020 | Goldman | A45D 20/10 |
| D913,617 | S * | 3/2021 | Santiago | D32/35 |
| 10,961,655 | B2 * | 3/2021 | Hinkey | F26B 21/001 |
| 2014/0317954 | A1 * | 10/2014 | McCallum | F26B 21/06 34/565 |
| 2014/0331513 | A1 * | 11/2014 | Nguyen | A43D 117/00 34/275 |
| 2018/0078113 | A1 * | 3/2018 | Nurlybekov | A47L 23/205 |
| 2021/0071950 | A1 * | 3/2021 | Ohnari | F26B 11/00 |
| 2021/0089040 | A1 * | 3/2021 | Ebrahimi Afrouzi | A47L 9/2894 |
| 2021/0222353 | A1 * | 7/2021 | Durham | D06F 34/26 |
| 2021/0401127 | A1 * | 12/2021 | Yoo | A43D 95/10 |

FOREIGN PATENT DOCUMENTS

| | | | | |
|---|---|---|---|---|
| CN | 109907717 | A | 6/2019 | |
| DE | 358859 | C | 9/1922 | |
| DE | 3912835 | A1 * | 12/1989 | F26B 21/006 |
| EP | 0627519 | A1 * | 12/1994 | F26B 9/06 |
| JP | H03-13831 | A | 1/1991 | |
| JP | 05-337002 | A | 12/1993 | |
| JP | 2002-296080 | A | 10/2000 | |
| JP | 2002-062046 | A | 2/2002 | |
| JP | 6119793 | B2 | 4/2017 | |
| KR | 20-0298088 | Y1 | 12/2002 | |
| KR | 20-0427782 | Y1 | 9/2006 | |
| KR | 101938421 | B1 | 1/2019 | |
| KR | 10-2008104 | B1 | 8/2019 | |
| KR | 102008104 | B1 | 8/2019 | |
| WO | WO-2021049846 | A1 * | 3/2021 | F26B 21/005 |

OTHER PUBLICATIONS

European Patent Office, "Supplementary European Search Report" dated Jun. 1, 2022, in connection with European Patent Application No. 20862284.5, 7 pages.

* cited by examiner

SHOE DRYER AND CONTROL METHOD THEREOF

CROSS-REFERENCE TO RELATED APPLICATIONS

This application is based on and claims priority under 35 U.S.C. § 119 to Japanese Patent Application No. 2019-164911, filed on Sep. 10, 2019, and Korean Patent Application No. 10-2020-0094017, filed on Jul. 28, 2020 in the Korean Intellectual Property Office, the disclosures of which are incorporated herein by reference.

BACKGROUND

1. Field

The disclosure relates to a shoe drier, and a method of controlling the same.

2. Description of the Related Art

There is known a conventional shoe closet equipped with a dry function in which a rack is provided in a shoe dry room provided inside a box body to place shoes thereon and a hot air discharge port is provided above the shelf such that the shoes on the rack are supplied with hot air obliquely from above the shoes (e.g., Patent Document 1).

RELATED ART DOCUMENT

Patent Document (Patent Document)

(Patent Document 1) Japanese Utility Model Patent Laid-Open Publication No. H3-13831

SUMMARY

In the case of adopting a configuration that blows air in the same direction regardless of the position of a mouth portion into which a foot is inserted, air mostly comes in contact with an outer side of the shoe, a toe portion of the shoe may be insufficiently dried. Meanwhile, when the temperature of air blowing is increased or the wind volume is increased, the shoe may be excessively dried.

Therefore, it is an object of the disclosure to provide a shoe drier capable of suppressing a shoe from being insufficiently dried or excessively dried, and a control method thereof.

Additional aspects of the disclosure will be set forth in part in the description which follows and, in part, will be obvious from the description, or may be learned by practice of the disclosure.

According to an aspect of the disclosure, there is provided a shoe dryer including: a main body; a shoe receiving portion provided inside the main body to receive a shoe; a blowing unit configured to blow air toward the shoe received in the shoe receiving portion; a camera configured to obtain an image of the shoe by photographing the shoe received in the shoe receiving portion; and a control device configured to recognize information about the shoe from the image of the shoe obtained by the camera, and control a direction of air blown by the blowing unit based on the information about the shoe.

The information about the shoe may include position information of a mouth portion of the shoe, and the control device may control the direction of air blown by the blowing unit to face toward a center of the mouth portion of the shoe.

The center of the mouth portion of the shoe may be a center of a circle or an ellipse that is approximated to a shape of an upper surface of the mouth portion of the shoe.

The blowing unit may include a blowing nozzle, and the blowing nozzle may be provided to be rotatable.

The shoe dryer may further include a driving unit configured to rotate the blowing nozzle to adjust a direction of discharged from the blowing nozzle.

The driving unit may include a motor that determines an amount of movement of the blowing nozzle based on a driving power waveform.

The blowing nozzle may include a plurality of blowing nozzles, and the plurality of blowing nozzles may include a first blowing nozzle configured to blow air toward a right-shoe and a second blowing nozzle configured to blow air toward a left shoe.

The first blowing nozzle may have a direction controlled independent of a direction of the second blowing nozzle.

The blowing nozzle may include a guide plate formed adjacent to a center of a flow path of the blowing nozzle to guide an air current.

The blowing nozzle may include an opening/closing mechanism formed at a suction port or a discharge port of the blowing nozzle to open and close a flow path of the suction port or the discharge port.

The blowing unit may further include an extension nozzle coupled to the blowing nozzle while extending into the shoe received in the shoe receiving portion.

The shoe receiving portion may include a first shoe receiving portion having a first partition to receive one pair of shoes and a second shoe receiving portion provided below the first shoe receiving portion and having a second partition to receive another pair of shoes, and the first partition may be detachably provided.

The shoe dryer may further include an accessary receiving portion provided inside the main body to receive a shoe accessary.

The shoe dryer may further include a manipulation portion configured to display the information about the shoe and a display element indicating a direction in which air is blown by the blowing unit, and perform manipulation on the display element using a finger or a speech.

According to another aspect of the disclosure, there is provided a method of controlling a shoe dryer including a shoe receiving portion configured to receive a shoe, and a blowing unit configured to blow air toward the shoe received in the shoe receiving portion, the method including: acquiring an image of the shoe received in the shoe receiving portion by photographing the shoe; recognizing information about the shoe from the obtained image of the shoe; and controlling a direction of air blown by the blowing unit based on the information about the shoe.

The recognized information about the shoe may include position information of a mouth portion of the shoe, and the direction of air blown by the blowing unit may be controlled to face toward a center of the mouth portion of the shoe.

The center of the mouth portion of the shoe may be a center of a circle or an ellipse that is approximated to a shape of an upper surface of the mouth portion of the shoe.

The method may further include determining an existence of a trigger to image the shoe.

The method may further include setting an operating mode according to the recognized information about the shoe.

The operating mode may include at least one of a temperature of air blown by the blowing unit, a wind volume of air blown by the blowing unit, a wind speed of air blown by the blowing unit, or an operating time of the shoe drier.

The disclosure provides a shoe drier including a main body, a shoe receiving portion provided in the main body and receiving a shoe, a blowing portion configured to blow air toward a surface of a shoe mouth portion of the shoe received in the shoe receiving portion, an image acquisition portion configured to obtain an image by photographing, and a controller configured to control a direction in which air is blown by the blowing portion according to shoe information contained in the image obtained by the image acquisition portion.

The controller may change the direction in which air is blown by the blowing portion using an electric motor that determines the amount of movement based on a driving power waveform. In this case, the controller may change the direction of air blown by the blowing portion that is returned to an initial value.

The shoe dryer may further include a temperature and humidity sensing device to detect temperature and humidity at a position passed by air from the shoes contained in the shoe receiving portion, and the controller may control the direction of air blown by the blowing portion according to the detection result of the temperature and humidity sensing device.

The controller may further control the amount and speed of air blown by the blowing portion.

The blowing portion may include a first blowing nozzle to blow air toward a right shoe and a second blowing nozzle to blow air toward a left shoe. In this case, the controller may independently control the direction of the first blowing nozzle and the direction of the second blowing nozzle.

The blowing portion may be provided on a side opposite to the shoe with respect to the surface of the shoe mouth portion.

The main body may have an insulating structure.

The image acquisition portion may be a camera provided on a wall surface of the shoe receiving portion or at an outer side of the main body.

The blowing portion may be provided on the wall surface of the shoe receiving portion. In this case, the wall surface may be a wall surface facing a heel portion of the shoe. In addition, the blowing portion may include a blowing nozzle having a shape having a soft curvature that is directed from the wall surface toward the shoe accommodated in the shoe receiving portion. In addition, as for a guide plate guiding the wind in the vicinity of the center of a flow path of the blowing nozzle, a leading edge of the guide plate has a cross section in a semicircle or semi-elliptical shape, and a trail edge of the guide plate has a cross section in which a connection portion between an upper side and a trailing edge is provided in a shape having a smooth curvature.

The blowing portion may have a blowing nozzle extendable to the shoes accommodated in a partition.

The blowing may include an opening/closing mechanism for opening and closing a flow path of air blown toward the shoes accommodated in the partition.

The shoe receiving portion may include a first shoe receiving portion having a first partition capable of receiving a pair of shoes, and shoe a second shoe receiving portion provided below the first shoe receiving portion and having a second partition capable of receiving a pair of shoes. In this case, the shoe receiving portion may be configured such that the first partition is detachable.

The shoe dryer may be provided at an inside of the main body with an accessory receiving portion for accommodating shoe accessories.

The shoe dryer may further include a manipulation portion configured to display information about shoes or a display element indicating a direction in which air is blown by the blowing portion, and to perform manipulation on the display element with a finger or a speech.

The shoe dryer may further include a manipulation portion on which an image obtained by the image acquisition portion is displayed, and which allows a manipulation of adjusting an operating condition of the shoe dryer to be performed. In this case, the manipulation portion may display an unset item among operating conditions in a first display form, and display a set item among the operating conditions in a second display form different from the first display form.

The shoe dryer may include: a circulation flow path 30 including a fan that sucks air from the shoe receiving portion, an evaporator that dehumidifies the air sucked by the fan, a condenser that heats the air that has passed through the evaporator, and a blowing portion that blows the air that has passed through the condenser toward the shoes accommodated in the shoe receiving portion; a sterilization portion provided in the circulation flow path to sterilize bacteria in the main body; and a deodorization portion provided in the circulation flow path to deodorize the odor inside the main body, and the controller may control the operating condition of the shoe dryer based on the shoe information contained in the image obtained by the image acquisition portion.

In this case, the operating condition may include at least one of the strength and weakness of sterilization by the sterilization portion, the temperature of the air blown by the blowing portion, the wind volume of the air blown by the blowing portion, the wind speed of the air blown by the blowing portion, and the operating time of the shoe drier.

The circulation flow path may be configured such that a flow path area at a discharge position immediately after the condenser is larger than a flow path area between the discharge position and the blowing portion.

The shoe dryer may have a flow path of air sucked by the fan at a periphery of or inside of the partition capable of accommodating shoes of the shoe receiving portion. In this case, the air flow path at the periphery or inside of the partition may be provided in a lower portion of the wall surface facing the blowing portion. In addition, the air flow path at the periphery or inside of the partition may have a flow path area larger than the flow path area at the discharge position of the blowing portion.

The sterilization portion has a discharge electrode and a ground electrode, and generate plasma by a voltage applied between the discharge electrode and the ground electrode, to sterilize bacteria in the main body.

The shoe dryer may further include a manipulation portion configured to display a display element indicating an operating condition and perform manipulation on the display element with a finger or a speech.

The shoe dryer may include a steam generator to generate steam in the circulation flow path.

The disclosure provides a method of controlling a shoe dryer including a main body, a shoe receiving portion provided in the main body and receiving a shoe, and a blowing portion configured to blow air toward a surface of a shoe mouth portion of the shoe received in the shoe receiving portion, the method including acquiring an image of the shoe received in the shoe receiving portion by photographing, and controlling a direction of air blown by the blowing portion based on shoe information contained in the obtained image.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

FIGS. 1 through 31, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, embodiments of the disclosure will be described in detail with reference to the accompanying drawings.

Figure 1:
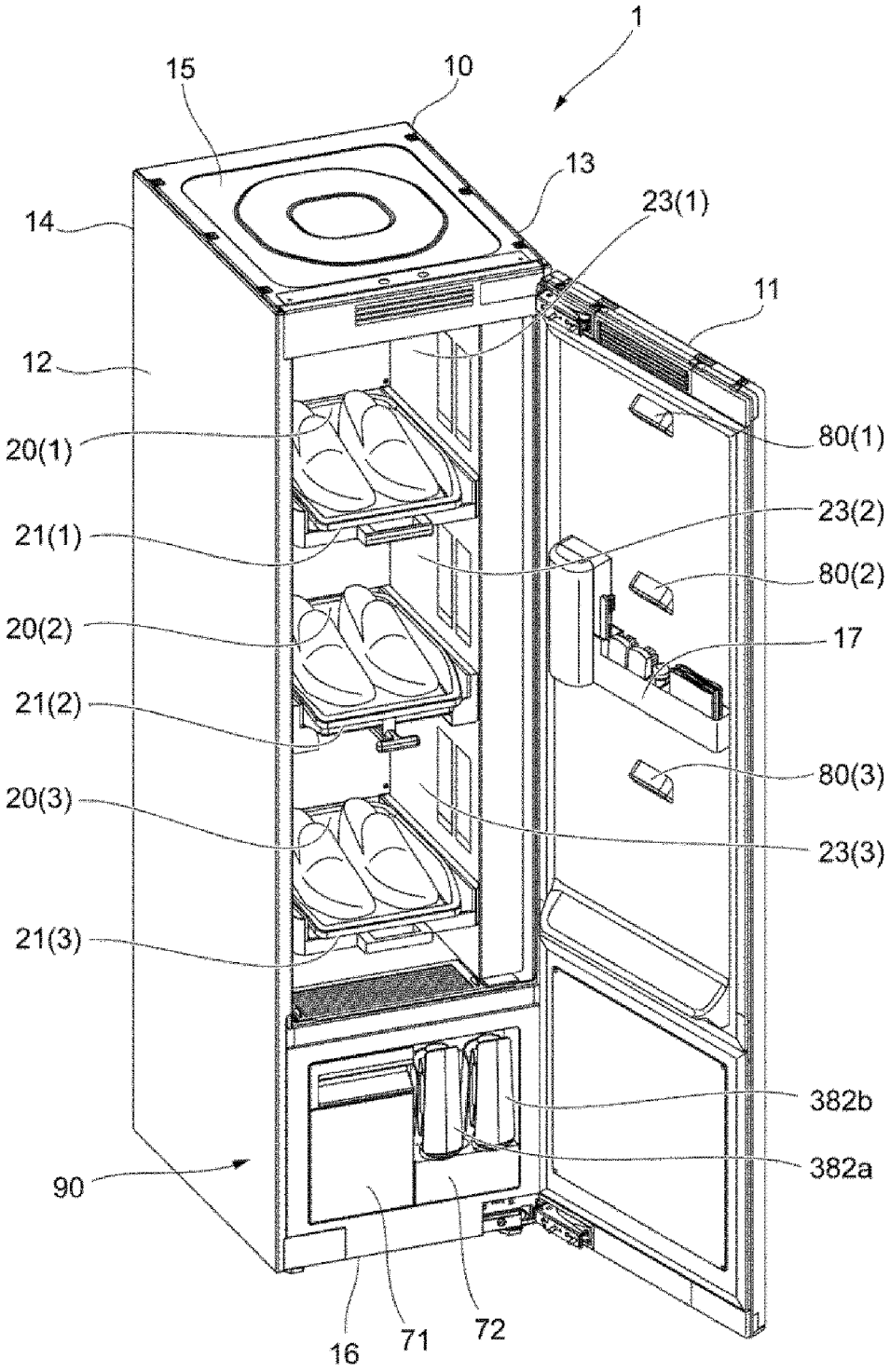
FIG. 1 is a perspective view illustrating the external appearance of a shoe dryer according to the first embodiment of the disclosure.
Figure 2:
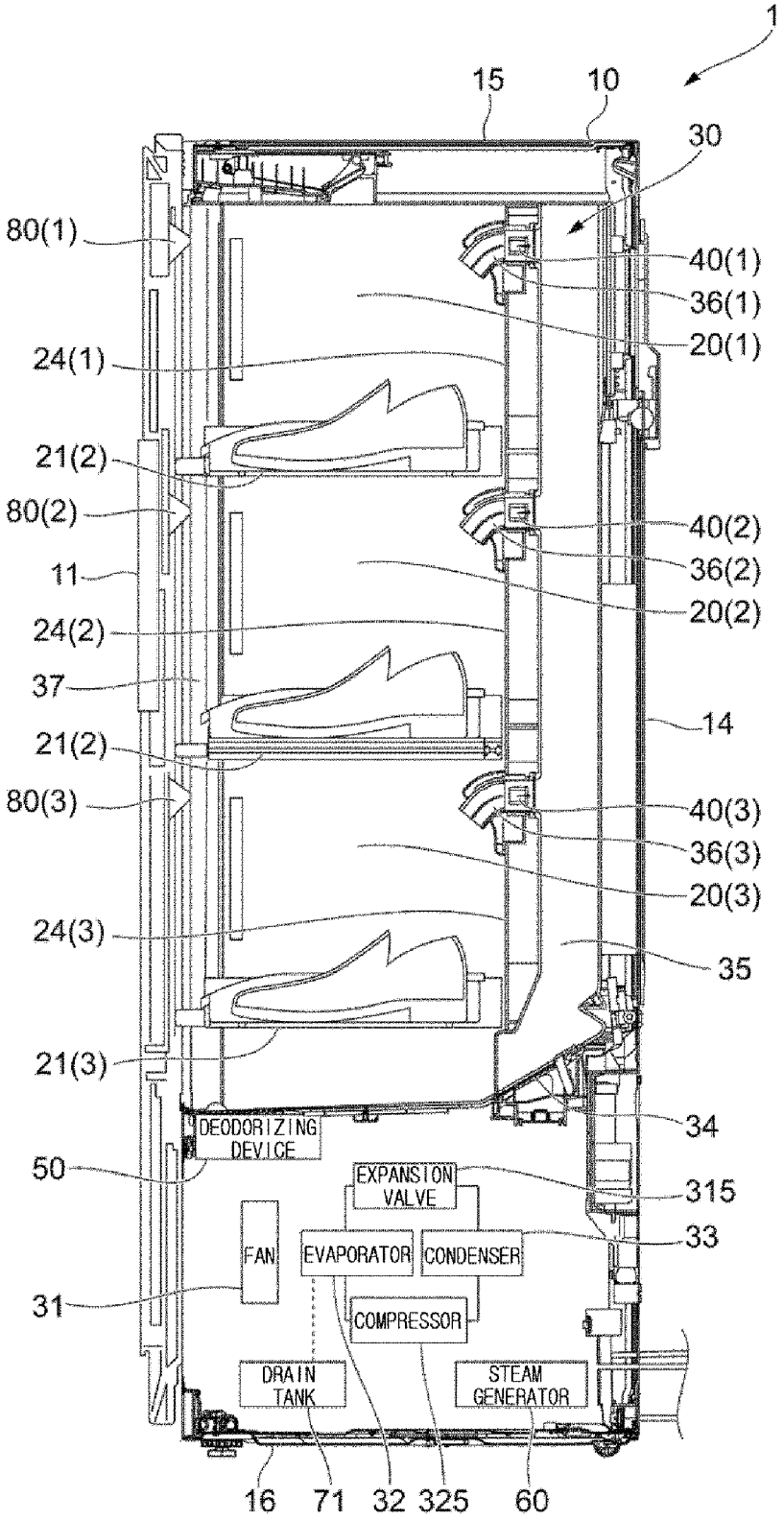
FIG. 2 is a side view illustrating the shoe dryer according to the first embodiment of the disclosure.
Figure 3:
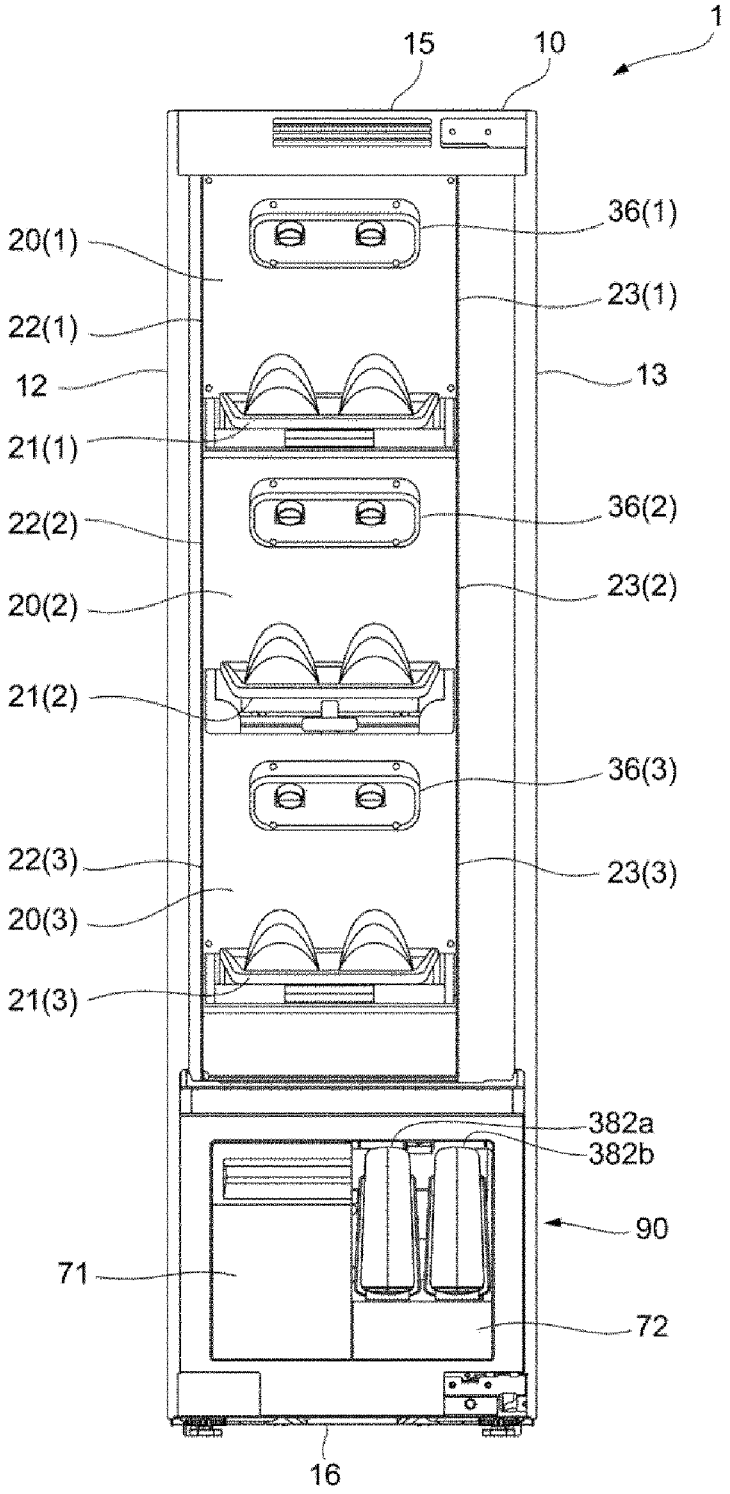
FIG. 3 is a front view illustrating the shoe dryer according to the first embodiment of the disclosure.

FIG. 1 is a perspective view illustrating the external appearance of a shoe dryer 1 according to the first embodiment of the disclosure. FIG. 2 is a side view illustrating the shoe dryer 1 according to the first embodiment of the disclosure. FIG. 3 is a front view illustrating the shoe dryer 1 according to the first embodiment of the disclosure.

Referring to FIGS. 1 to 3, the shoe dryer 1 according to the embodiment includes a main body 10 constituting an external appearance thereof. The main body 10 may preferably have an insulating structure, but may not have an insulating structure. The main body 10 includes a door 11 provided on the front side to be openable such that shoes are inserted or withdrawn therethrough, a left side plate 12 constituting the left side, a right side plate 13 constituting the right side, a rear side plate 14 constituting the rear side, a top plate 15 constituting the top side, and a bottom plate 16 constituting the bottom side. In addition, an accessory receiving portion 17 for receiving shoe accessories is provided at an inner side of the door 11. Here, a boot attachment (382*a*, 382*b*), which is one of the shoe accessories, is stored in a machine room below the main body 10 as shown in the drawing.

In addition, referring to FIGS. 1 to 3, the shoe dryer 1 according to the embodiment is provided with shoe receiving portions 20(1) to 20(3) to receive shoes. Here, the shoe receiving portions 20(1) to 20(3) are described, but may be simply described as a shoe receiving portion 20 unless needed to be distinguished from each other. In addition, although three shoe receiving portions 20 are shown in the drawing, one, two, or four or more shoe receiving portions 20 may be provided.

The shoe receiving portions 20(1) to 20(3) are provided with partitions 21(1) to 21(3), respectively, each of which may accommodate one pair of shoes, so that the partitions 21(1) to 21 may accommodate up to three pairs of shoes with one pair of shoes accommodated for each partition. Here, the partitions 21(1) to 21(3) are described, but may be simply described as a partition 21 unless needed to be distinguished from each other. In addition, although three partitions 21 are shown in the drawing because three shoe receiving portions 20 are provided, the number of partitions 21 may be changed according to the number of shoe receiving portions 20. Here, the partition 21 may be installed directly on the main body 10, and may be provided to be movable using a slide rail.

The shoe receiving portion 20(1) to 20(3) include left wall surfaces 22(1) to 22(3) on the left side, right wall surfaces 23(1) to 23(3) on the right side, and rear wall surfaces 24(1) to 24(3) on the rear side. In addition, the left wall surfaces 22(1) to 22(3), the right wall surfaces 23(1) to 23(3), and the rear wall surfaces 24(1) to 24(3) may be provided in unitary bodies as a left wall surface 22, a right wall surface 23, and a rear wall surface 24, each of which is used in common with the shoe receiving portions 20(1) to 20(3), but for the sake in convenience of description, each part facing a respective one of the shoe receiving portions 20 (1) to 20 is separately illustrated. In addition, although three left wall surfaces 22, three right wall surfaces 23, and three rear wall surfaces 24 are shown in the drawings because three shoe receiving portions 20 are provided, the number of the left wall surfaces 22, the right wall surfaces 23, and the rear wall surfaces 24 may be changed according to the number of shoe receiving portions 20.

In addition, as shown in the drawings, the shoe dryer 1 according to the embodiment has a circulation flow path 30 for dehumidifying and drying the shoe receiving portion 20 by circulating air in the main body 10. In addition, the circulation flow path 30 includes a fan 31, an evaporator 32, a condenser 33, a discharge flow path 34, a rear flow path 35, blowing units 36(1) to 36(3), and a front flow path 37.

The fan 31 sucks air from the shoe receiving portion 20. Although one fan 31 is shown in the drawing, a plurality of the fans may be provided.

The evaporator 32 is disposed on a downstream side of the fan 31 and evaporates a refrigerant that has been expanded by an expansion valve 315 into a low temperature and low-pressure refrigerant, thereby cooling and dehumidifying the air sucked by the fan 31. The condenser 33 condenses a refrigerant that has been compressed by the compressor 325 into a high temperature and high-pressure refrigerant, thereby reheating the air that has passed through the evaporator 32.

The discharge flow path 34 is a flow path of a portion through which air immediately passing through the condenser 33 is discharged to the rear flow path 35. The rear flow path 35 is a flow path provided between the rear side plate 14 of the main body 10 and the rear wall surface 24 of the shoe receiving portion 20, and configured to distribute air having passed through the condenser 33 and discharged from the discharge flow path 34 into the shoe receiving portion 20.

The blowing units 36(1) to 36(3) are provided on the rear wall surfaces 24(1) to 24(3) of the shoe receiving portions 20(1) to 20(3), respectively, and serve to blow air from the rear flow path 35 toward the shoes accommodated in the partitions 21(1) to 21(3). Here, the blowing units 36(1) to 36(3) are described, but may be simply described as the blowing unit 36 unless needed to be distinguished from each other. In addition, although three blowing units 36 are shown in the drawing because three shoe receiving portions 20 are provided, the number of blowing units 36 may be changed according to the number of the shoe receiving portions 20. Further, the position of the blowing unit 36 is not limited to the rear wall surface 24, and the blowing unit 36 may be provided on other wall surfaces, such as the left wall surface 22, the right wall surface 23, and the ceiling (not shown). In the embodiment, the blowing unit 36 is provided as an example of a blowing portion.

The front flow path 37 is a flow path on the side of the door 11 through which air sucked from the shoe receiving portion 20 by the fan 31 flows.

Figure 4:
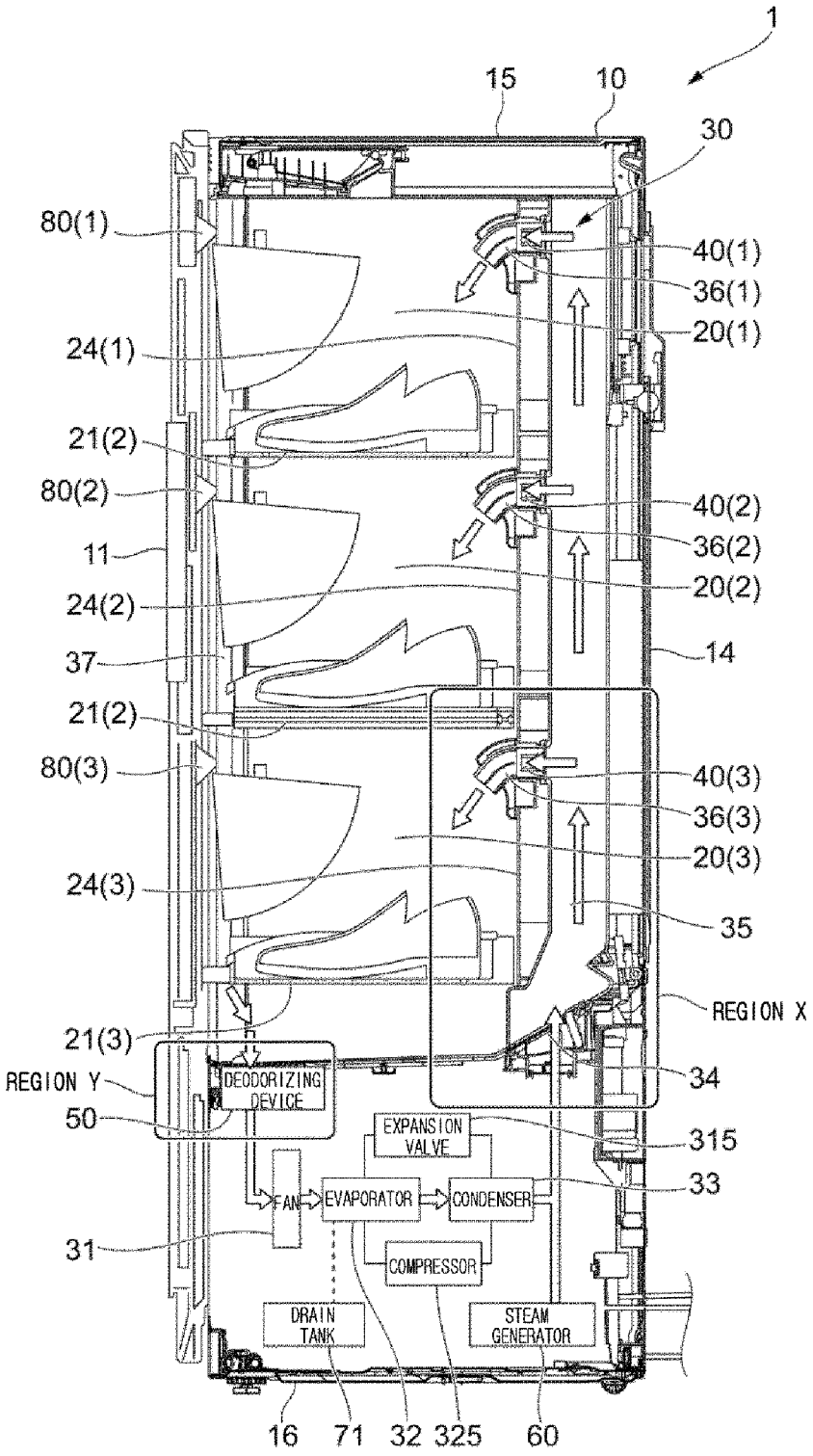
FIG. 4 is a side view illustrating the shoe dryer according to the first embodiment of the disclosure, which shows a flow of wind in a circulation flow path and a photographing range of a camera to overlap each other.

In FIG. 4, the flow of wind (air current) in the circulation flow path 30 is indicated by a white arrow. Here, the white arrow from a deodorizing device 50 to the evaporator 32 indicates a flow of air with a high humidity, and the white arrow from the evaporator 32 to the condenser 33 indicates a flow of air with a low humidity, the white arrow from the condenser 33 or the steam generator 60 to the rear flow path 35 indicates a flow of air with a high temperature. In addition, in the circulation flow path 30, the fan 31 is provided on the upstream side of the evaporator 32, but the position of the fan 31 is not limited thereto. The fan 31 may be provided on the downstream side of the condenser 33 or may be provided inside each blowing unit 36.

In addition, although not shown in the drawings, the shoe dryer 1 may have a duct for introducing air outside the main body 10 into the shoe receiving portion 20 and then discharging the air inside the shoe receiving portion 20 to the outside of the main body 10.

Further, as shown in the drawings, the shoe dryer 1 according to the embodiment includes sterilization units 40(1) to 40(3), a deodorization device 50, a steam generator 60, a drain tank 71, and a water supply tank 72.

The sterilization units 40(1) to 40(3) are provided in the blowing units 36(1) to 36(3), respectively, and sterilize bacteria inside the main body 10. Here, the sterilization units 40(1) to 40(3) are described, but may be simply described as a sterilization unit 40 unless needed to be distinguished from each other. In addition, although three sterilization units 40 are shown in the drawings because three shoe receiving portions 20 are provided, the number of sterilization units 40 may be changed according to the number of shoe receiving portion 20. In the embodiment, the sterilization unit 40 is provided as an example of a sterilization portion.

The deodorizing device 50 is provided in the circulation flow path 30 and deodorizes an odor in the main body 10. In the embodiment, the deodorizing device 50 is provided as an example of a deodorizing portion.

The steam generator 60 is provided in the circulation flow path 30 and generates steam in the circulation flow path 30. In the embodiment, the steam generator 60 is provided as an example of a steam generating portion.

The drain tank 71 stores moisture condensed in the evaporator 32. The water supply tank 72 stores water supplied to the steam generator 60.

Further, as shown in the drawings, the shoe dryer 1 according to the embodiment includes cameras 80(1) to 80(3) and a control device 90.

The cameras 80(1) to 80(3) are provided on the wall surfaces of the shoe receiving portions 20(1) to 20(3), respectively, and capture an image of the shoe (a photograph of the shoe) accommodated in the shoe receiving portions 20(1) to 20(3). Here, the wall surface may refer to a wall surface constantly forming a wall surface of the shoe receiving portion 20 or may refer to a wall surface temporarily forming a wall surface of the shoe receiving portion 20. Examples of the former include the left wall surface 22, the right wall surface 23, and the rear wall surface 24 of the shoe receiving portion 20, as well as a ceiling surface (not shown). Examples of the latter may include an inner surface of the door 11 that becomes the front wall surface of the shoe receiving portion 20 when the door 11 is closed. In the drawings, a case where the cameras 80(1) to 80(3) are installed on the inner surface of the door 11 is shown. In addition, the camera 80 may acquire many-sided images of the shoes using a mirror.

In FIG. 4, the photography ranges by the cameras 80(1) to 80(3) are shown in the shape of a fan centered on the cameras 80(1) to 80(3). Here, the cameras 80(1) to 80(3) are described, but may be simply described as a camera 80 unless needed to be distinguished from each other. Although three cameras 80 are shown in the drawings because three shoe receiving portions 20 are provided, the number of cameras 80 may be changed according to the number of the shoe receiving portions 20.

The camera 80 may capture an image of a product tag or a barcode that contains information about the shoes (shoe information). In this case, the camera 80 may be provided on the outer side of the main body 10 without needing to be provided on the wall surface of the shoe receiving portion 20 inside in the main body 10.

In the embodiment, the camera 80 is provided as an example of an image acquisition portion that acquires an image through photographing.

The control device 90 determines shoe information from an image captured by the camera 80. Here, the shoe information includes, for example, the type, shape, size, and material of the shoe. When the image captured by the camera 80 is an image of a shoe, the shoe information may be determined by, for example, image matching processing between the captured image and a previously registered image. In addition, when the image captured by the camera 80 is an image of a product tag or a barcode, the shoe information may be determined by, for example, performing character recognition processing on characters written on the product tag or analysis processing on information represented in barcodes. Then, the control device 90 sets an operating mode in the shoe dryer 1 according to the determined shoe information. The operating mode may include at least one of the strength of sterilization by the sterilization unit 40, the temperature of the air blown by the blowing unit 36, the wind volume of the air blown by the blowing unit 36, the wind speed of the air blown by the blowing unit 36, and the operating time of the shoe dryer 1, but is not limited thereto.

For example, at a time of initial control, the control device 90 registers a result of determining material by a user from the image captured by the camera 80. Then, the control device 90 automatically determines an initial condition of dehumidification drying (the number of rotations of the fan 31, the frequency of the compressor 325, and the like) and an initial operating condition of the sterilization unit 40 (the current or voltage value).

In addition, at a time of control during operation, the control device 90 determines a condition of dehumidification drying (the number of rotations of the fan 31, the frequency of the compressor 325, and the opening degree of the expansion valve 315) and an operating condition of the sterilization unit 40 (the current or voltage value) according to a value of a sensor provided in the main body 10. Then, the control device 90 allows the shoe dryer 1 to automatically operate according to the determined condition, or stop operation.

In the embodiment, an operating mode is used as an example of the operating condition, and the control device 90 is provided as an example of a control portion that controls the operating condition of the shoe dryer 1 based on shoe information contained in an image.

Therefore, shoe care may be performed while suppressing shoes from being damaged due to sterilization or heat.

Further, the control device 90 may be implemented in software or hardware. When implemented in software, the control device 90 may include a central processing unit (CPU), a random-access memory (RAM), a read-only memory (ROM), and the like, and for example, the CPU may read a program stored in the ROM into RAM and execute the program. Alternatively, the software loaded into the RAM in a system equipped with an operating system (OS) may be software stored in an external storage device, such as a hard disk drive (HDD) or a secure digital SD (registered trademark) card.

Hereinafter, the components included in the shoe dryer 1 will be described in detail.

(Discharge Flow Path and Rear Flow Path)

Figure 5:
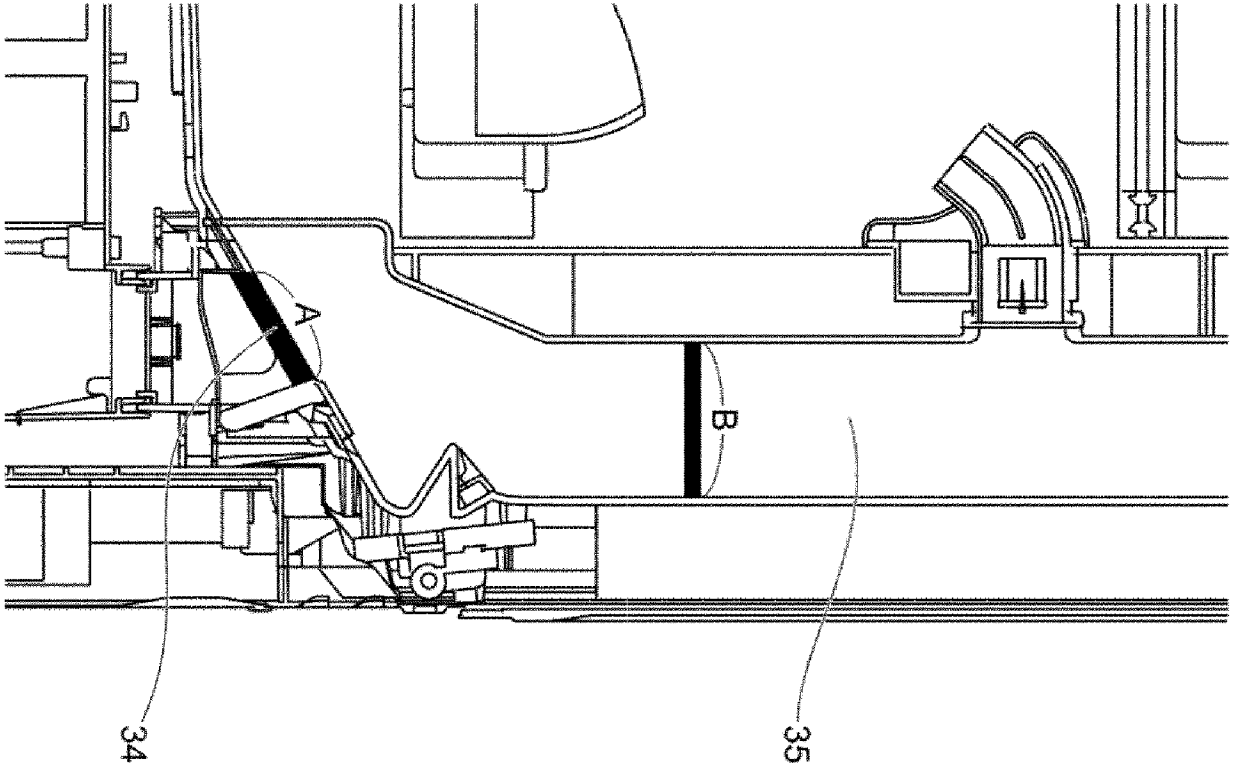
FIG. 5 is an enlarged view illustrating region X in the side view of the shoe dryer shown in FIG. 4.

FIG. 5 is an enlarged view illustrating region X in the side view of the shoe dryer 1 shown in FIG. 4. As shown in FIG. 5, according to the embodiment, the rear flow path 35 has an area B larger than an area A of the discharge flow path 34. Here, the area A of the discharge flow path 34 refers to a flow path area at a discharge position immediately after the condenser 33, and the area B of the rear flow path 35 refers to a flow path area between the discharge position and the blowing unit 36. As an aspect, it is preferable that the flow path area from the discharge flow path 34 to the rear flow path 35 is gradually expanded. However, the flow path area may be rapidly expanded.

Since the flow path area is expanded from the discharge flow path 34 to the rear flow path 35 as such, a part of dynamic pressure of air passing through the discharge flow path 34 is converted into static pressure, the static pressure passing through the rear flow path 35 rises, and when the flow is distributed from the rear flow path 35 to the shoe receiving portion 20, the influence of the dynamic pressure may be suppressed. Therefore, such a configuration may facilitate uniform distribution of wind from each blowing unit 36, and thus facilitates distribution of wind to each shoe receiving portion 20 with a uniform wind volume.

(Blowing Unit)

The blowing unit 36 may have any configuration as long as it can blow air from the rear flow path 35 to the shoe receiving portion 20. For example, the blowing unit may have a louver shape in which a plurality of thin plates are arranged in parallel. In the embodiment, it is assumed that the blowing unit 36 has a blowing nozzle.

Figure 6:
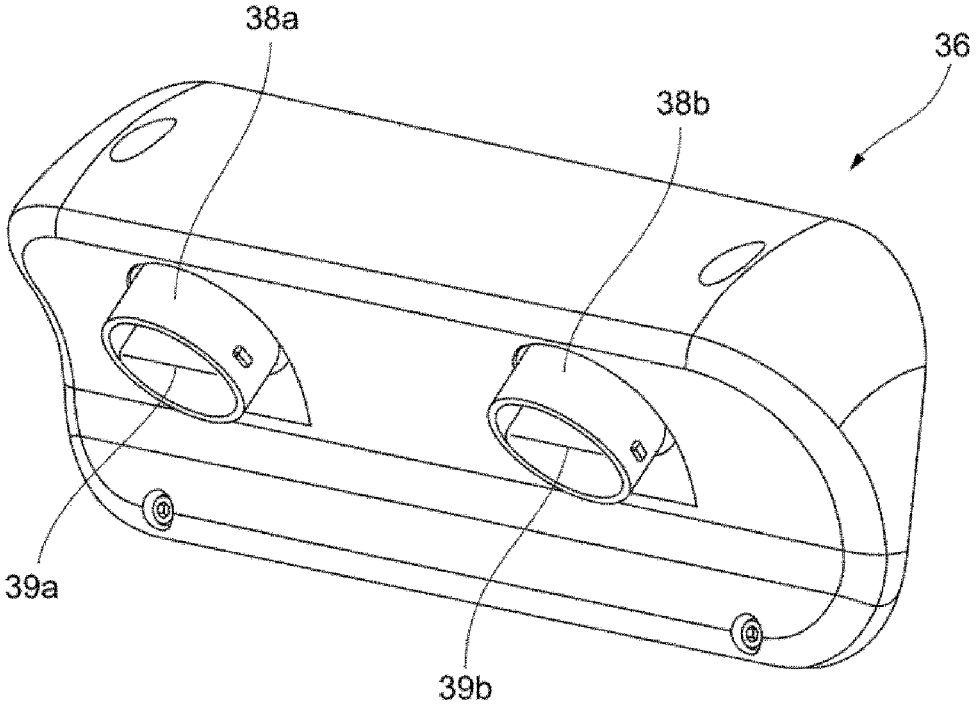
FIG. 6 is a perspective view illustrating the external appearance of a blowing unit according to the embodiment of the disclosure.

FIG. 6 is a perspective view illustrating the external appearance of the blowing unit 36 according to the embodiment of the disclosure. Referring to FIG. 6, the blowing unit 36 includes a blowing nozzle 38*a* for blowing air to the right shoe and a blowing nozzle 38*b* for blowing air to the left shoe. In addition, the blowing nozzles 38*a* and 38*b* are described, but may be simply described as a blowing nozzle 38 unless needed to be distinguished from each other. Therefore, in other words, it may be assumed that the blowing unit 36 is provided with two blowing nozzles 38 for one pair of shoes, so that air may be blown to each of the left and right shoes. In the embodiment, the blowing nozzle 38*a* is provided as an example of a first blowing nozzle for blowing air toward the right shoe, and the blowing nozzle 38*b* is provided as an example of a second blowing nozzle for blowing air toward the left shoe.

By providing the blowing nozzle 38 for each of the left and right shoes as such, air may be blown only to a desired part, thereby improving the efficiency of shoe care (sterilization, drying, or the like).

In addition, guide plates 39*a* and 39*b* for guiding wind are provided adjacent to the centers of the flow paths of the blowing nozzles 38*a* and 38*b*, respectively. Unless needed to be distinguished from each other, the guide plates 39*a* and 39*b* may be simply described as a guide plate 39.

Figure 7A:
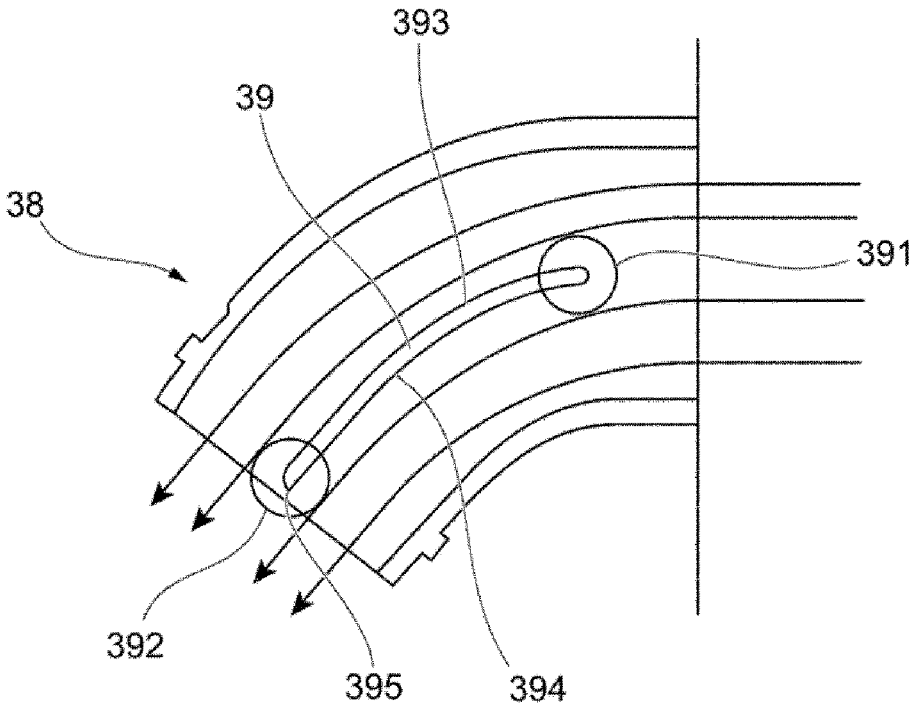
FIG. 7A is a cross-sectional view illustrating a blowing nozzle according to the embodiment of the disclosure.
Figure 7B:
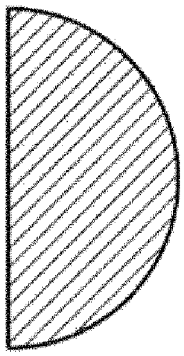
FIGS. 7B and 7C are views illustrating cross-sectional shapes of a leading edge of the blowing nozzle.
Figure 7C:
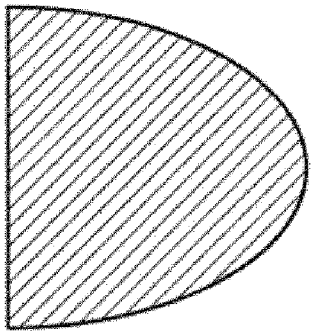
Figure 7D:
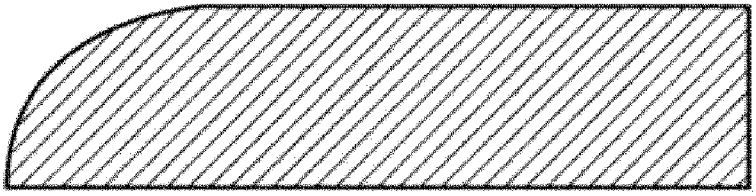
FIG. 7D is a view illustrating a cross-sectional shape of a trailing edge of the blowing nozzle.

FIG. 7A is a cross-sectional view illustrating the blowing nozzle 38 according to the embodiment of the disclosure. In the embodiment, the cross section of the blowing nozzle 38 is provided in a shape having a smooth curvature obliquely formed downward from the rear wall surface 24 to extend toward the shoe accommodated in the shoe receiving portion 20. In addition, the cross section of a leading edge 391 of the guide plate 39 has a semicircular shape shown in FIG. 7B or a semi-elliptical shape shown in FIG. 7C. In addition, the cross section of a trailing edge 392 of the guide plate 39 has a shape shown in FIG. 7D. That is, a connection portion between an upper side 393 and a trailing edge end portion 395 is provided in a shape having a smooth curvature. On the other hand, a lower side 394 has a flat shape. In addition, the lower side 394 does not need to have a flat shape, but preferably, may have a flat shape.

By forming the cross section of the blowing nozzle 38 to have a shape with a smooth curvature as such, loss in the flow path, such as flow separation, may be suppressed, and air may be efficiently blown to the shoes. Further, by providing the guide plate 39, the flow separation in the flow path may be further suppressed. In addition, by forming the cross-section of the leading edge 391 of the guide plate 39 to have a shape shown in FIGS. 7C and 7C, leading edge flow separation is suppressed, and by forming the cross-section of the trailing edge 392 to have a shape shown in FIG. 7D, trailing edge flow separation is suppressed, so that the blowing efficiency is improved.

Figure 8A:
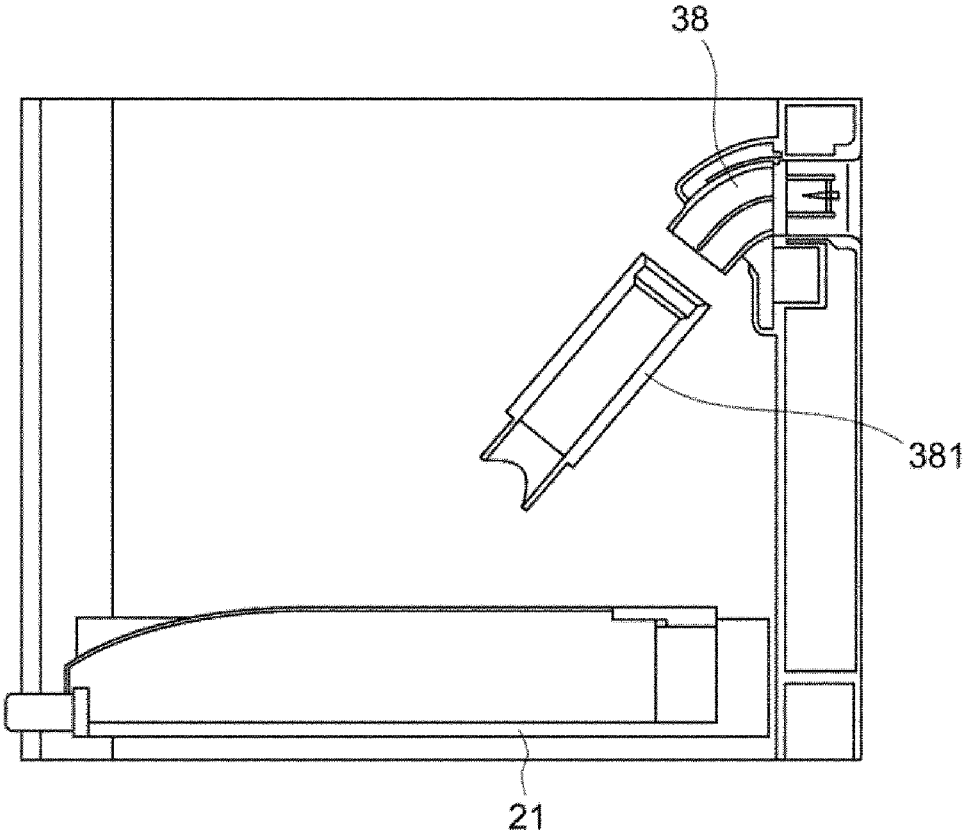
FIGS. 8A and 8B are views illustrating insertion of an extension nozzle according to the embodiment of the disclosure.
Figure 8B:
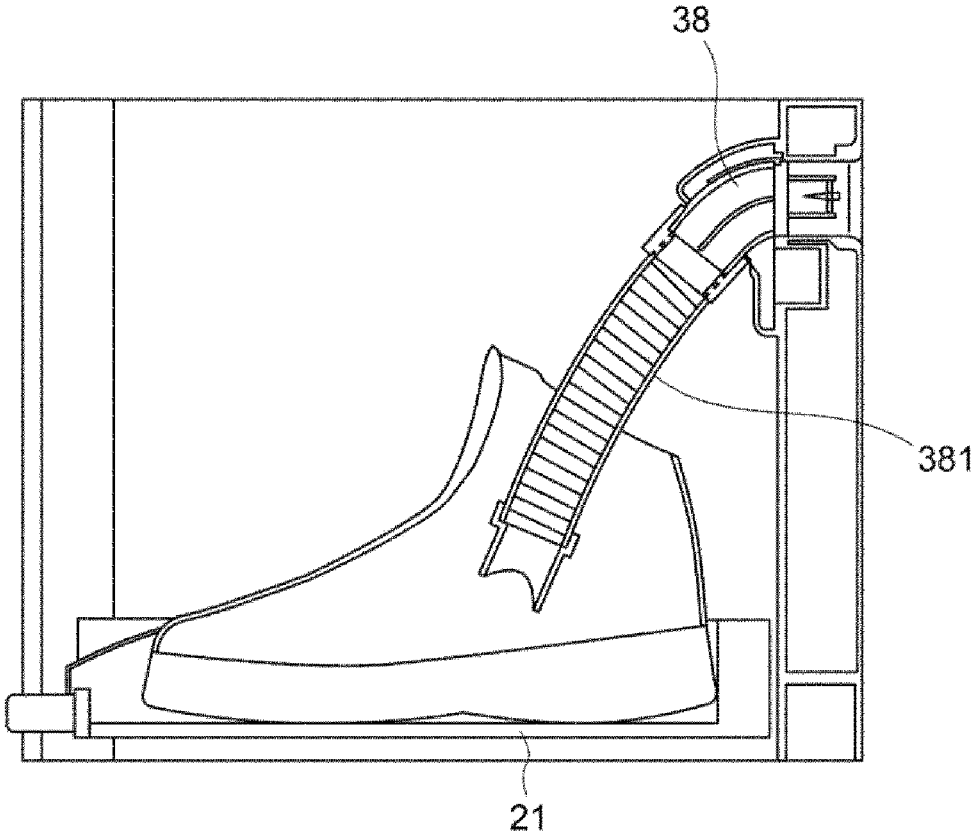

FIGS. 8A and 8B are views illustrating insertion of an extension nozzle 381. Referring to FIG. 8A, the extension nozzle 381 is prepared. Here, shoes are not accommodated in the partition 21. In addition, the extension nozzle 381 is assumed to have a bellows shape, but a bellows is not shown due to the extension nozzle 381 not being extended in FIG. 8A. After that, as shown in FIG. 8B, the extension nozzle 381 is installed at a tip end of the blowing nozzle 38 and extended to be inserted into the shoe. Alternatively, the blowing nozzle 38 may be provided in a mechanically extending and contracting structure such that the blowing nozzle 38 is extended to be inserted into the shoe. By extending the blowing nozzle 38 as such, air may be blown into a shoe even with a special shape or an extremely narrow opening.

In addition, in the embodiment, a damper may be provided as an example of an opening/closing mechanism that is provided at a suction port or discharge port of the blowing nozzle 38 to open and close a flow path of the suction port or the discharge port of the blowing nozzle 38. Then, the sterilization or drying state of the shoes is determined according to information from a temperature/humidity sensor in each shoe receiving portion 20, and the damper of the blowing nozzle 38 corresponding to the shoe receiving portion 20 in which the shoe care has been completed is closed. Therefore, air is prevented from being blown to the shoe receiving portion 20, in which shoe care has been completed and air blowing is not needed, so that even when a plurality of pairs of shoes having different states are simultaneously inserted into the shoe receiving portions 20 and subject to operation, the air blowing may be stopped in an appropriate state for each shoe receiving portion 20.

To this end, the control device 90 starts the operation of the shoe dryer 1, and checks information obtained from the temperature/humidity sensor of each shoe receiving portion 20 every predetermined time. In addition, in response to existence of a temperature/humidity sensor outputting information indicating that shoe care has been completed, the control device 90 outputs a signal for closing the damper of the blowing nozzle 38 for the shoe receiving portion 20 corresponding to the temperature/humidity sensor. Further, even in response to determining that a trigger for capturing an image exists, the control device 90 checks information obtained from the temperature/humidity sensor. In addition, in response to existence of a temperature/humidity sensor that outputs information indicating that shoe care has been completed, the control device 90 closes the damper of the blowing nozzle 38 for the shoe receiving portion 20 corresponding to the temperature/humidity sensor and prevent a subsequent process from being performed.

(Front Flow Path)

Figure 9:
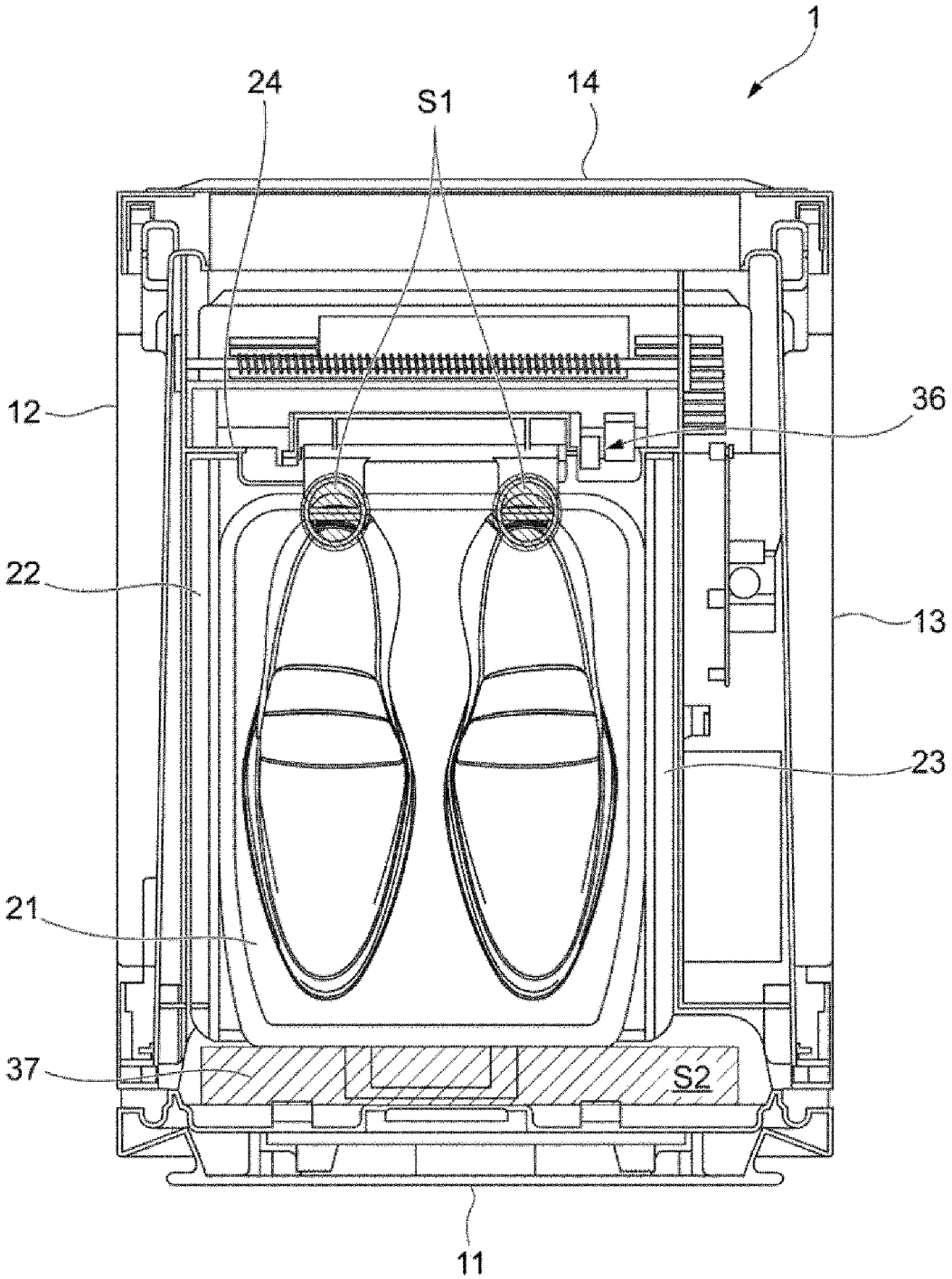
FIG. 9 is a plan view illustrating the shoe dryer according to the embodiment of the disclosure.

Preferably, the partition 21 and the door 11 may be provided to make no contact with each other. Accordingly, a space between the partition 21 and the door 11 forms the front flow path 37, so that air passing by the shoe is easily sucked by the fan 31. Here, in order to increase the drying efficiency by discharging the high-humidity wind inside the shoes out of the shoe receiving portion 20 without being stagnated in the shoe receiving portion 20, the front flow path 37 may be installed on a lower portion of a wall surface facing the blowing unit 36. In addition, in terms of pressure loss during drying, that is, in order to reduce the wind pressure in the front flow path 37 to be lower than the wind pressure at the discharge position of the blowing unit 36, the front flow path 37 may preferably have a flow path area that is larger than that of the discharge portion of the blowing unit 36. In FIG. 9 showing the shoe dryer 1, the flow path area at the discharge position of the blowing unit 36 is shown as S1, and the flow path area of the front flow path 37 is shown as S2. The front flow path 37 is not limited to the area between the partition 21 and the door 11, and may be provided in any portion of the periphery of the partition 21. In this case, the front flow path 37 is an example of an air flow path around the partition.

Alternatively, the partition 21 and the door 11 may make contact with each other, and an opening may be provided in the partition 21. Accordingly, the opening provided in the partition 21 becomes the front flow path 37, and the air passing by the shoe is easily sucked by the fan 31. In this case, the front flow path 37 is an example of an air flow path in the partition.

(Sterilization Device)

The sterilization unit 40 may be disposed at any position in the rear flow path 35 and the blowing unit 36, but preferably, may be disposed inside the blowing nozzle 38 of the blowing unit 36 installed on the rear wall surface 24 of the shoe receiving portion 20. Therefore, here, the sterilization units 40 disposed in the blowing nozzles 38*a* and 38*b* will be described as sterilization units 40*a* and 40*b*.

Figure 10A:
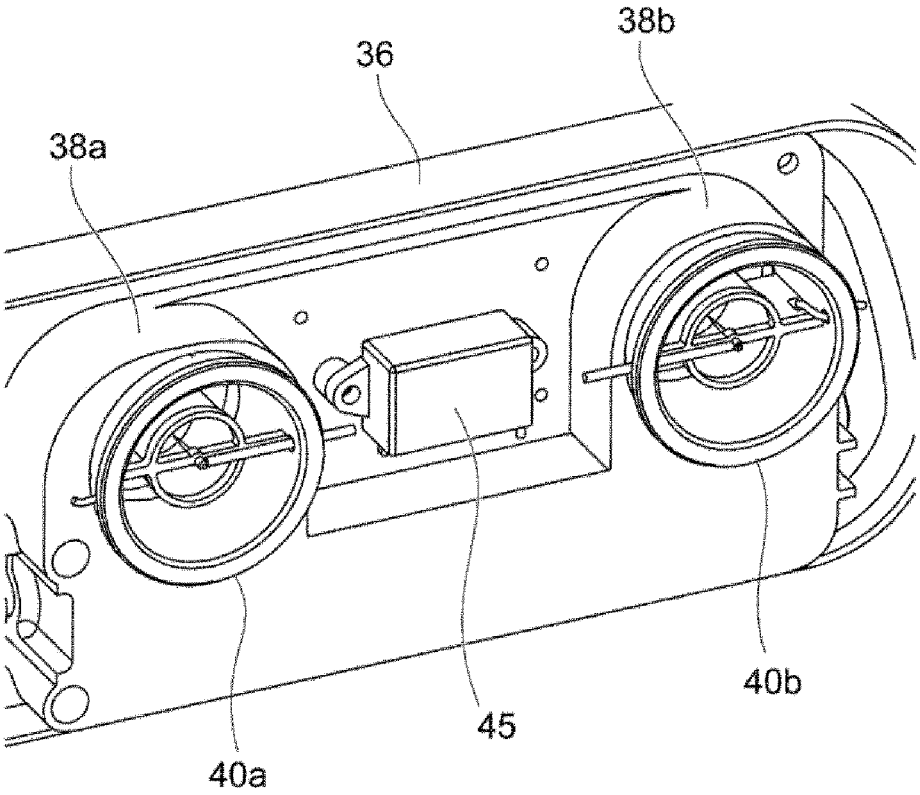
FIG. 10A is a view illustrating the configuration of the blowing unit in which a sterilization unit is disposed.

FIG. 10A is a view illustrating the configuration of the blowing unit 36 in which the sterilization units 40*a* and 40*b* are disposed. The blowing unit 36 includes the sterilization units 40*a* and 40*b* and a high frequency power supply 45 for applying a high frequency voltage to the sterilization units 40*a* and 40*b*.

Figure 10B:
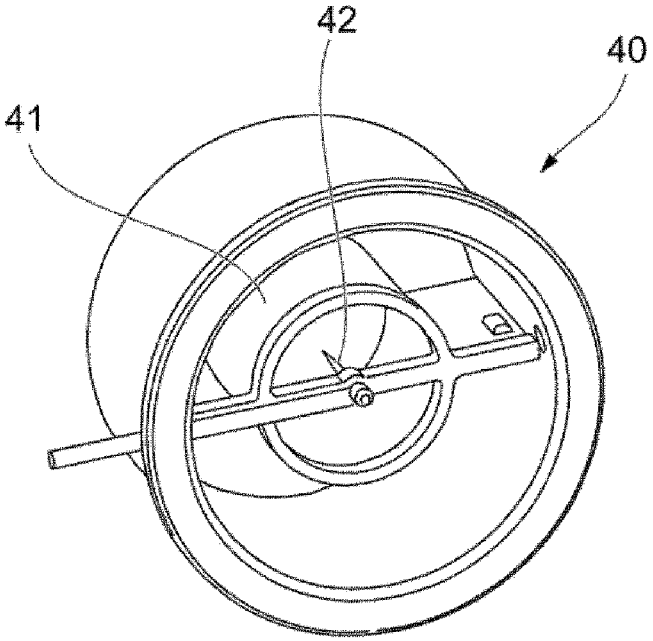
FIG. 10B is a view illustrating the configuration of the sterilization unit.

FIG. 10B is a view illustrating the configuration of the sterilization unit 40. As shown in FIG. 10B, the sterilization unit 40 includes a discharge electrode 41 and a ground electrode 42. The sterilization unit 40 generates plasma by applying a voltage between the discharge electrode 41 and the ground electrode 42 using the high frequency power supply 45 shown in FIG. 10A, thereby sterilizing bacteria in the main body 10. As such, the sterilization unit 40 may deodorize the shoes by sterilizing causative organisms that cause the smell of shoes.

(Deodorizing Device)

Figure 11:
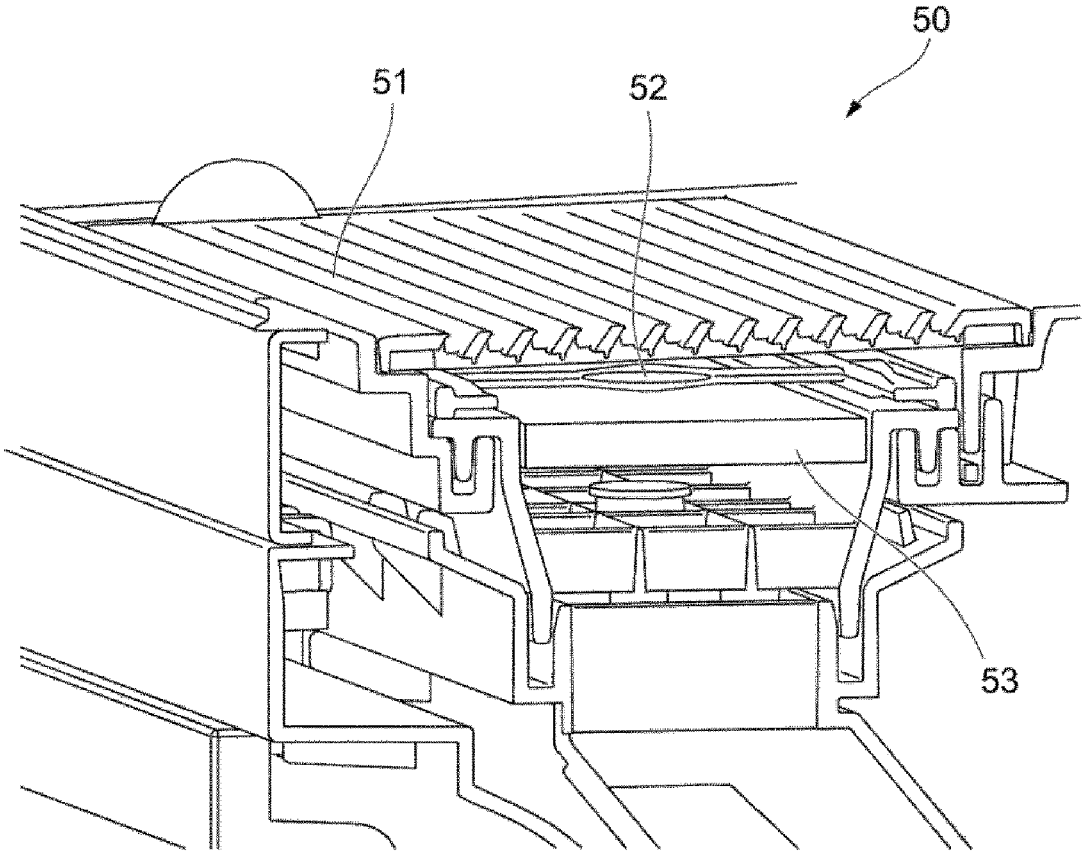
FIG. 11 is an enlarged view illustrating region Y of the side view of the shoe dryer shown in FIG. 4.

FIG. 11 is an enlarged view of region Y in the side view of the shoe dryer 1 shown in FIG. 4, and shows an example of installation of the deodorizing device 50. As shown in FIG. 11, the deodorization device 50 includes a filter guard 51, a pre-filter 52, and a deodorization filter 53. The filter guard 51 protects the pre-filter 52 and the deodorization filter 53. The pre-filter 52 removes dust or dirt from the shoes. The deodorization filter 53 removes odors in the air that may not be removed by the pre-filter 52. Here, the deodorization filter 53 may be provided in any type of deodorization filter, for example, an odor adsorption type deodorization filter and an odor decomposition type deodorization filter. The deodorizing device 50 is preferably installed between the shoe receiving portion 20 and the fan 31 in the circulation flow path 30, but is not limited thereto. For example, the deodorizing device 50 may be installed at any position in the circulation flow path 30. By installing the deodorizing device 50 in the circulation flow path 30 as described above, the odor generated from the shoes may be removed.

(Shoe Receiving Portion)

The shoe receiving portions 20(1) to 20(3) may allow long shoes, such as long boots, to be accommodated by separating one of the partitions 21(1) to 21(3).

Figure 12:
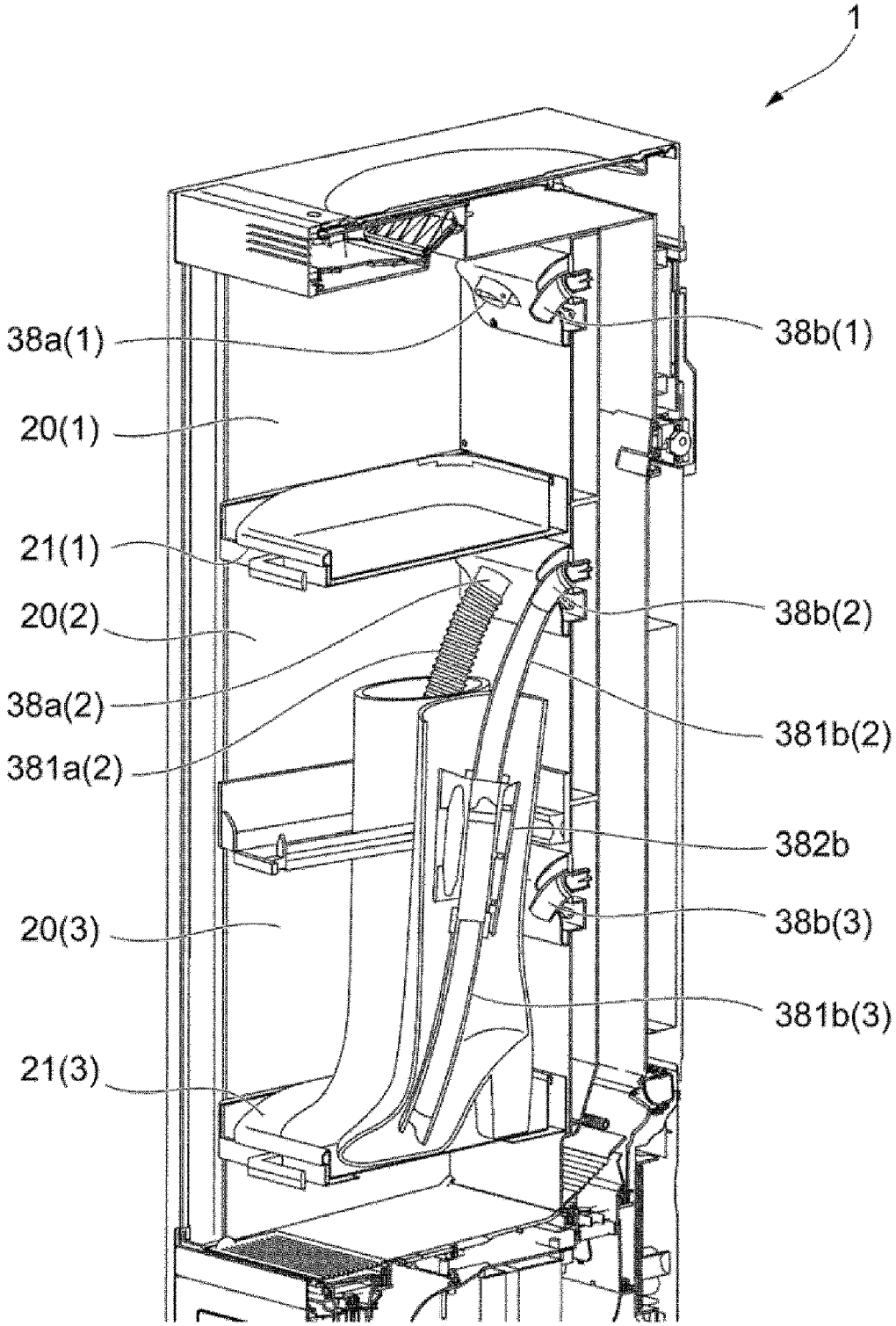
FIG. 12 is a perspective view illustrating a state of the shoe dryer according to the embodiment of the disclosure, in which a partition is removed.

FIG. 12 is a perspective view illustrating a state of the shoe dryer 1. Here, the partition 21 (2) is removed and the long boots are accommodated in the shoe receiving portions 20 (2) and 20 (3). In this case, the partition 21 (2) is an example of a first partition, and the shoe receiving portion 20(2) is an example of a first shoe receiving portion. In addition, the partition 21 (3) is an example of a second partition, and the shoe receiving portion 20(3) is an example of a second shoe receiving portion.

Here, in the shoe dryer 1 according to the embodiment, the extension nozzle 381 is provided for each blowing nozzle 38. In the following description, extension nozzles 381 provided to be inserted into the blowing nozzles 38*a*(1), 38*b*(1), 38*a*(2), 38*b*(2), 38*a*(3), and 38*b*(3) are referred to as extension nozzles 381*a*(1), 381*b*(1), 381*a*(2), 381*b*(2), 381*a* (3), and 381*b*(3), respectively.

When long boots accommodated in the partition 21(3) are able to stand alone, the extension nozzles 381*a*(2) and

381*b*(2) are installed on the blowing nozzles 38*a*(2) and 38*b*(2), respectively, to be inserted into the long boots. On the other hand, when long boots accommodated in the partition 21(3) are unable to stand alone, installing the extension nozzles 381*a* (2) and 381*b* (2) in the blowing nozzles 38*a*(2) and 38*b*(2), respectively, and inserting the extension nozzles 381*a* (2) and 381*b* (2) may not provide an appropriate state for care. For this, boot attachments 382*bs* are provided at the front sides of the extension nozzles 381*a*(2) and 381*b*(2), respectively, as shown in a cut-away perspective view of the left side long boot in FIG. 12. Further, the extension nozzles 381*a*(3) and 381*b*(3), which are originally provided to be inserted into the blowing nozzles 38*a*(3) and 38*b*(3), are mounted at the front sides of the boot attachments 382*b*, respectively.

Figure 13A:
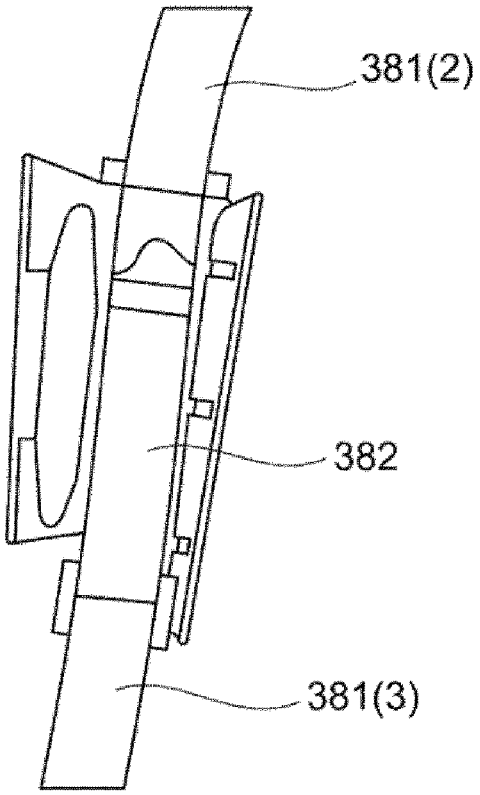
FIG. 13A is an enlarged view illustrating a state in which extension nozzles are installed using a boot attachment.
Figure 13B:
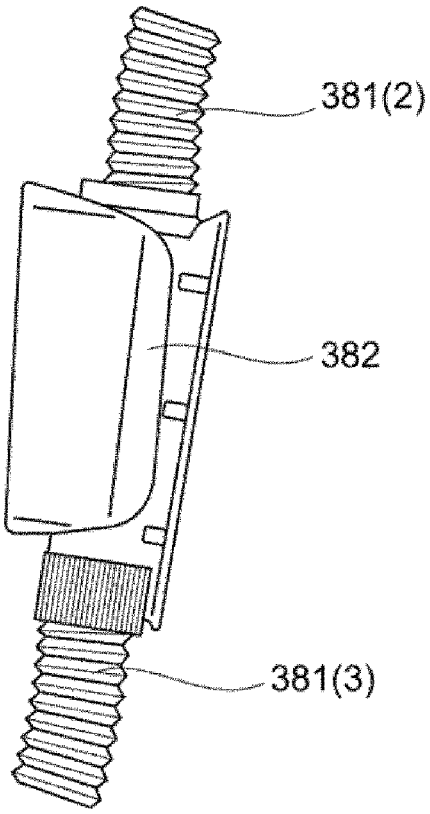
FIG. 13B is an enlarged view illustrating a state in which extension nozzles are installed using a boot attachment.

FIGS. 13A and 13B are enlarged views illustrating a state in which the extension nozzles 381(2) and 381(3) are installed using the boot attachments 382.

FIG. 13A is a cross-sectional view during installation of the boot attachment 382. The boot attachments 382 are inserted into the long boots in a state narrower than an opening of the long boots, and then are widen by elasticity to be fixed to the long boots.

FIG. 13B is a perspective view illustrating a state after the extension nozzle 381(3) is installed. The extension nozzles 381(2) and 381(3) are connected to each other through the boot attachment 382.

As such, one of the partitions 21 is allowed to be separated so that the shoe dryer 1 may easily store tall shoes with a great height.

(Door)

The accessory receiving portion 17 disposed at an inner side of the door 11 of the shoe dryer 1 according to the embodiment has a structure, an upper surface of which is open such that shoe accessories, such as a shoe brush, cloth, or cream, are inserted or hung from above. However, the structure of the accessory receiving portion 17 is not limited thereto, and may have a box shape with a lid provided thereon. In addition, the position of the accessory receiving portion 17 is not limited to the inner side of the door 11, and the accessory receiving portion 17 may be provided in other positions within the main body 10. For example, as a shoe accessory, the extension nozzle 381 connected to the blowing nozzle 38 may be accommodated on the right wall surface 23 of the shoe receiving portion 20. In addition, the shoe accessory may include the boot attachment 382, and the accessory receiving portion 17 for accommodating the boot attachment 382 may also be provided at any position within the main body 10.

By providing the accessory receiving portion 17 in the main body 10 as such, all of the shoe care products may be stored in the main body 10, so that there is no need to secure a separate place for managing the shoe care products at an outer side of the main body 10.

Figure 14A:
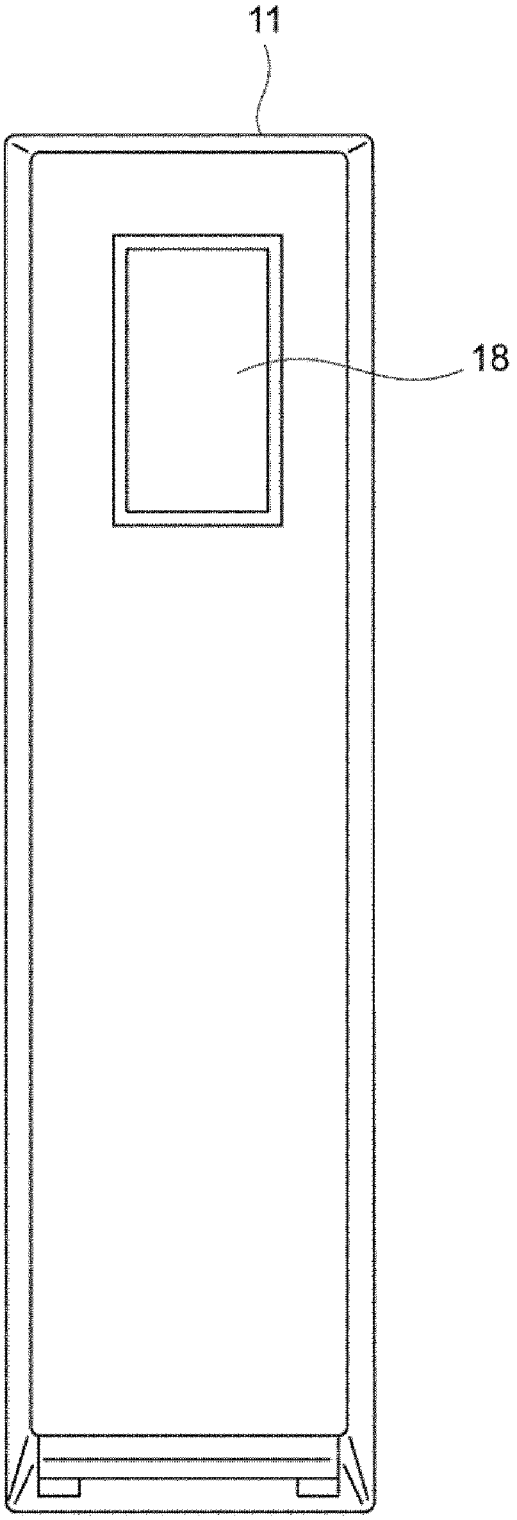
FIG. 14A is a view illustrating the external appearance of a door of the shoe dryer according to the embodiment of the disclosure.

FIG. 14A is a view illustrating the external appearance of the door 11 of the shoe dryer 1 according to the embodiment. As shown in FIG. 14A, a touch panel 18 is provided at an outer side of the door 11. The touch panel 18 displays a shoe image captured by the camera 80 or an operating mode set by the control device 90. For example, the user may check the operating mode while viewing the shoe image, and when the operating mode is not appropriate for the type, shape, size, material, etc. of the shoe that may be identified from the shoe image, switch the displayed operating mode by touching the touch panel 18 with a finger. Alternatively, the operating mode may be switched by selecting a display element, such as a button, displayed on the touch panel 18 by a speech. In this case, since the display element, such as a button, does not need to be touched, it is referred in more broad view that a manipulation portion may be provided at an outer side of the door 11.

To this end, the control device 90 receives a user instruction from the manipulation portion while the operating mode is being displayed on the touch panel 18. When the user instruction indicates an intention not to change the operating mode, the control device 90 sets the displayed operating mode in the shoe dryer 1. On the other hand, when the user instruction indicates an intention to change the operating mode, the control device 90 changes the displayed operating mode and sets the changed operating mode in the shoe dryer 1.

As such, by providing the manipulation portion at an outer side of the door 11, the user may check the set operating mode at a glance, thereby facilitating manipulation.

Here, the operation on the touch panel 18 will be described in more detail.

Figure 14B:
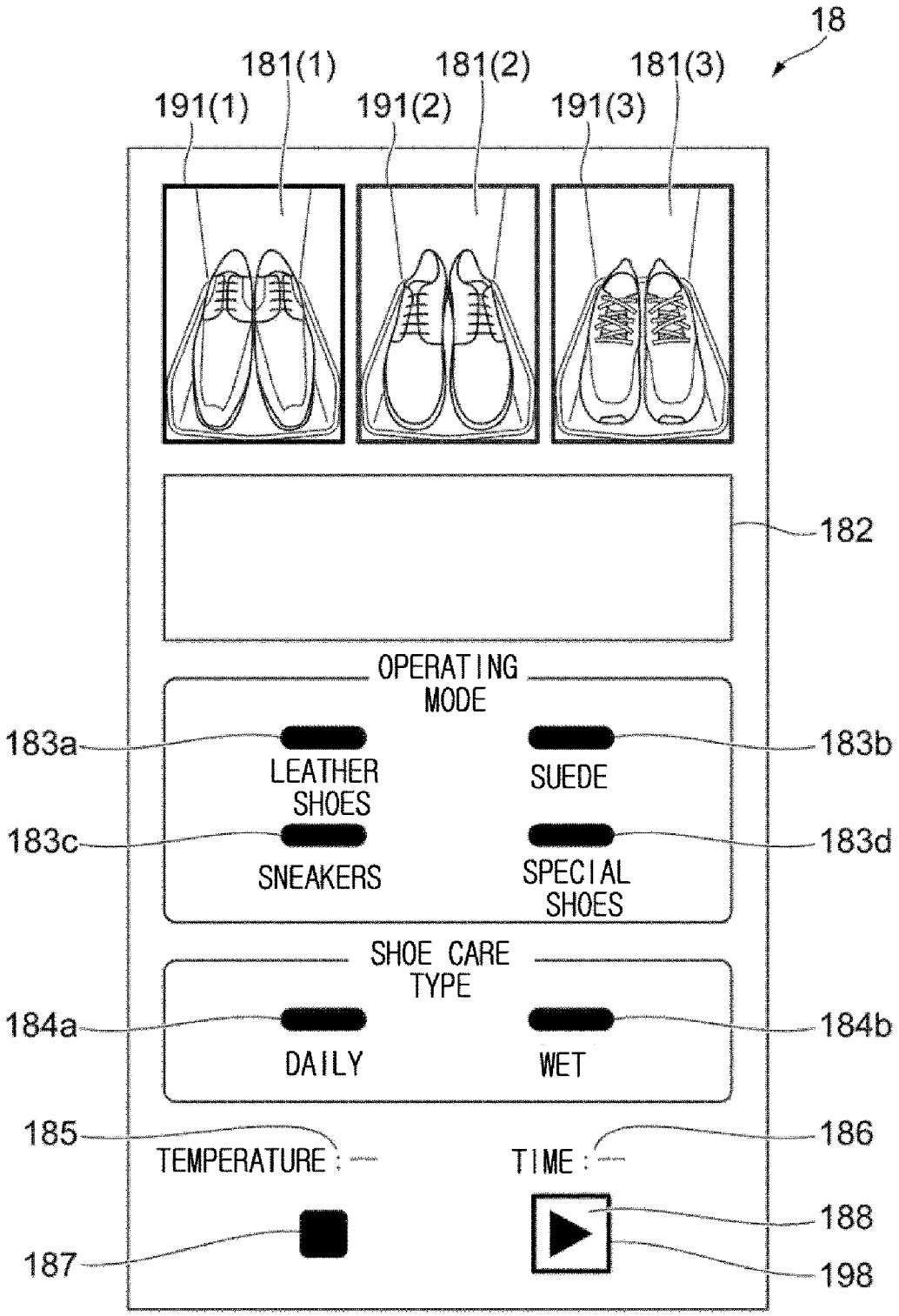
FIG. 14B is a view illustrating a specific example of display contents displayed on a touch panel of the shoe dryer according to the embodiment of the disclosure.

FIG. 14B is a view illustrating a specific example of display contents displayed on the touch panel 18. On the touch panel 18, shoe image areas 181(1) to 181(3), a text area 182, operating mode buttons 183*a* to 183*d*, shoe care type buttons 184*a* and 184*b*, an operating temperature area 185, an operating time area 186, a stop button 187, and a start button 188 are displayed.

The shoe image areas 181(1) to 181(3) are areas for displaying images of shoes (shoe images) accommodated in the shoe receiving portions 20(1) to 20(3), respectively. In addition, in the shoe image areas 181(1) to 181(3), borders 191(1) to 191(3) that may be blinked or lighted are also displayed.

The text area 182 is an area for displaying a text message indicated to a user.

The operating mode buttons 183*a* to 183*d* are buttons for setting an operating mode according to the type of shoe. Unless needed to be distinguished from each other, the operating mode buttons 183*a* to 183*d* may be simply indicated as an operating mode button 183.

The shoe care type buttons 184*a* and 184*b* are buttons for setting the shoe care type, that is, care for a daily shoe or care for a shoe wet with water. Unless needed to be distinguished from each other, the shoe care type buttons 184*a* to 184*d* may be simply described as a shoe care type button 184.

The operating temperature area 185 is an area displaying a set internal temperature of the shoe dryer 1 that is a temperature when the shoe dryer 1 operates. The operating time area 186 is an area displaying a set operating time of the shoe dryer 1.

The stop button 187 is a button for stopping the operation of the shoe dryer 1. The start button 188 is a button for starting the operation of the shoe dryer 1. In addition, in the start button 188, a border 198 that may be blinked or lighted is also displayed.

Hereinafter, the flow of manipulations displayed on the touch panel 18 shown in FIG. 14B will be described in detail.

First, the user opens the door 11 and accommodates shoes in the shoe receiving portions 20(1) to 20(3).

When the user closes the door 11 or presses a recognition start button, the control device 90 displays shoe images captured by the camera 80 in the shoe image areas 181(1) to 181(3), and starts recognizing the shoes. In this case, the control device 90 displays a text "recognition" on the text area 182, and displays the progress of shoe recognition as a level of 0% to 100%. After the shoe recognition is finished, the user designates selection by touching a certain part of the shoe images displayed on the shoe image areas 181(1) to 181(3), by which the control device 90 displays information about the shoe in the text area 182. Here, the text representing the shoe information is, for example, "No shoes", "Unregistered shoes", "Shoes (or leather shoes)". In addition, the control device 90 blinks the border 191 of the shoe image area 181 until an operating mode is set for the shoe image displayed on the shoe image area 181, and changes the boarder to be turned on when the operating mode is set for the shoe image displayed on the shoe image area 181.

Subsequently, the user designates selection by touching one of the operating mode buttons 183*a* to 183*d* to set the operating mode according to the type of shoe.

When the selected shoe image among the shoe images displayed in the shoe image areas 181(1) to 181(3) is a shoe image recognized for the first time, the control device 90 blinks all the four operating mode buttons 183*a* to 183*d*, and displays a text, such as "Please select an operating mode" in the text area 182. In this state, when the user touches and selects one of the operating mode buttons 183*a* to 183*d*, the control device 90 turns off the unselected operating mode buttons 183 and turns on the selected operating mode button 183.

When the selected shoe image among the shoe images displayed in the shoe image areas 181(1) to 181(3) is a shoe image that has been previously recognized, the control device 90 blinks the operating mode button 183 corresponding to an operating mode that has been registered at a time of the shoe previously recognized, and displays a text, such as "Would you like to operate in the previously registered operating mode?" in the text area 182. To operate in the previously registered operating mode, the user designates selection by touching the blinking operating mode button 183. Then, the control device 90 changes the selected operating mode button 183 to be turned on, and then registers the operating mode corresponding to the selected operating mode button 183. On the other hand, when changing the previously registered operating mode, the user designates selection by touching the operating mode button 183 that is not blinking among the operating mode buttons 183*a* to 183*d*. Then, the control device 90 turns off the blinking operating mode buttons 183, turns on the selected operating mode button 183, and then registers the operating mode corresponding to the selected operating mode button 183.

Subsequently, the user designates selection by touching one of the shoe care type buttons 184*a* and 184*b* to set the shoe care type, and updates the operating temperature and operating time according to the shoe care type.

When the shoe care type is not set, the control device 90 blinks both the shoe care type buttons 184*a* and 184*b*. In this state, the user selects the shoe care type button 184*a* in response to routine care for shoes, and selects the shoe care type button 184*b* in response to care for shoes wet in water. As such, when the user selects the shoe care type button 184*a* or the shoe care type button 184*b*, the control device 90 turns off the unselected shoe care type button 184, and changes the selected shoe care type button 184 to be turned on, and then updates the operating temperature and operating time. In addition, the control device 90 displays a shoe care type and an operating mode set according to the shoe image displayed in the shoe image areas 181(1) to 181(3) in the text area 182. For example, the control device 90 display a text "operation in routine shoe care, leather-shoes mode".

After that, the user performs an operation start task.

When both the operating mode button 183 and the shoe care type button 184 have been blinking as the above are changed to be turned on, the control device 90 blinks a border 198 of the start button 188. In this state, when the user presses the start button 188, the control device 90 changes the border 198 of the start button 188 to be turned on. Then, the control device 90 operates the shoe dryer 1 in the registered operating mode.

On the other hand, when the operation of the shoe dryer 1 is finished, the shoe dryer 1 automatically performs the operation stop operation, and the control device 90 stops the operation of the shoe dryer 1. In this case, when the blowing unit 36 adjusts the wind direction, the blowing nozzle 38 is returned to a home position, as will be described below in the second embodiment.

When the user presses the stop button 187, the control device 90 stops the operation of the shoe dryer 1. In this case, when the blowing unit 36 adjusts the wind direction, the blowing nozzle 38 is returned to a home position as will be described below in the second embodiment.

Meanwhile, in the above, the operating mode button 183 and the border 191 are blinked until the operating mode is set, and when the operating mode is set, are changed to be turned on, but the disclosure is not limited thereto. The operating mode button 183 and the border 191 may be displayed in a first display form until the operating mode is set, and when the operating mode is set, may be displayed in a second display form different from the first display form.

In addition, in the above, the shoe care type button 184 is blinked until the shoe care type is set, and when the shoe care type is set, is changed to be turned on, but the disclosure is not limited thereto. The shoe care type button 184 may be displayed in a first display form until the shoe care type is set, and when the shoe care type is set, may be displayed in a second display form different from the first display form.

In addition, when both the operating mode button 183 and the shoe care type button 184 are changed to be turned on, the border 198 of the start button 188 is blinked, and when the start button 188 is pressed, the boarder of the start button 188 is changed to be turned on, but the disclosure is not limited thereto. When both the operating mode button 183 and the shoe care type button 184 are changed to be turned on, the border 198 of the start button 188 is displayed in a first display form, and when the start button 188 is pressed, the border 198 of the start button 188 may be displayed in a second display form different from the first display form.

Further, the arrangement of the respective buttons of the touch panel 18 of FIG. 14B is an example, and the buttons may be arranged in other positions. The operating mode is also an example, and other types of shoes may be described. The shoe care type is also an example, and may include a degree of wetness or a deodorization mode. In addition, text, operating mode, shoe care type, temperature, time, etc. may be written in the shoe image.

(Steam Generator)

The shoe dryer 1 according to the embodiment may include the steam generator 60 that generates steam in a circulation flow path and blows the steam into the shoe receiving portion 20. Specifically, when it is determined that the humidity in the main body 10 has significantly decreased based on a value of a humidity sensor provided in the main body 10, the steam generator 60 generates steam by heating water in the water supply tank 72 and blows the steam into the shoe receiving portion 20.

By providing the steam generator 60 as such, an appropriate humidity environment in the main body 10 is provided.

(Control Device)

Figure 15:
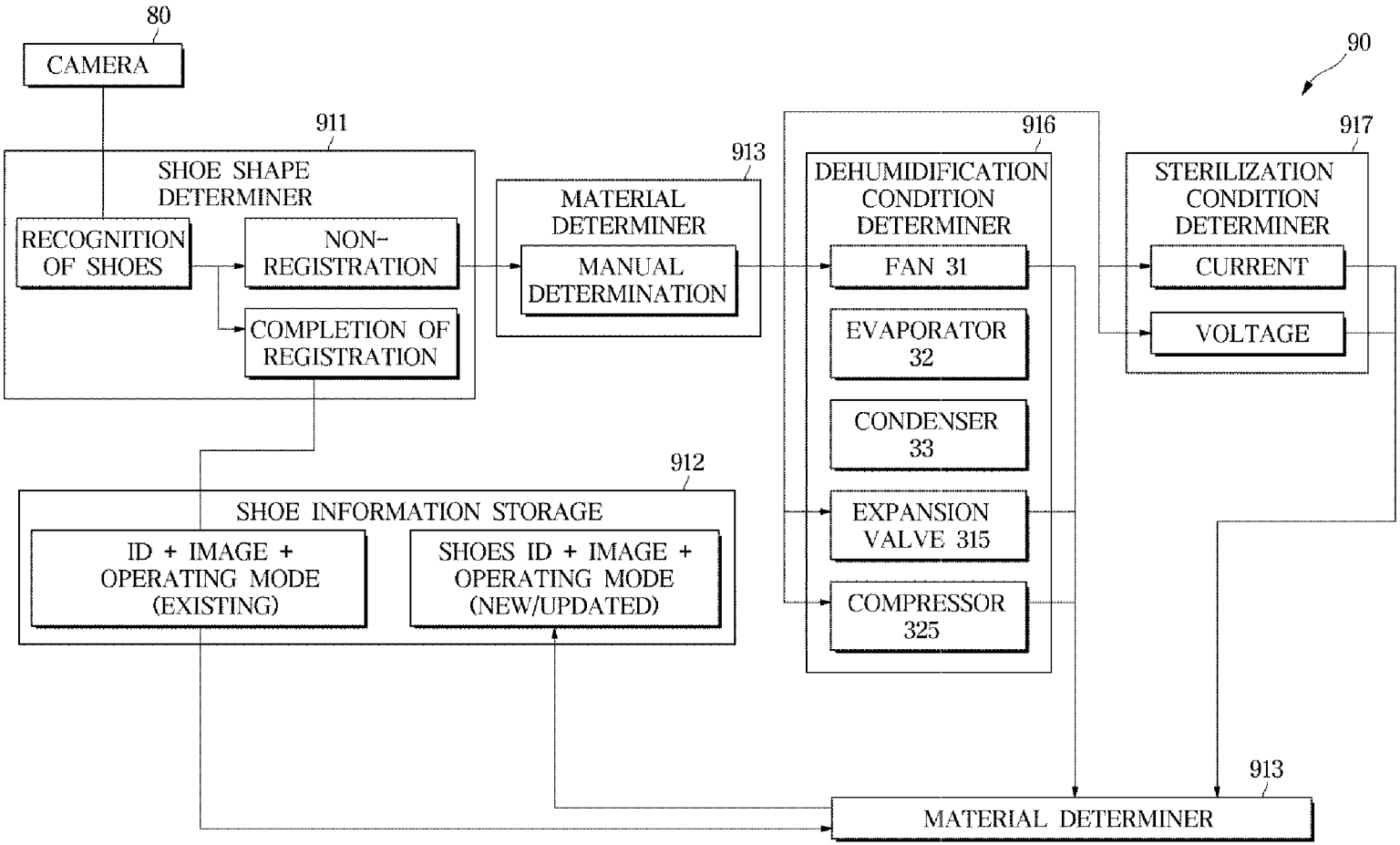
FIG. 15 is a block diagram illustrating an example of a functional configuration for initial control of a control device for the shoe dryer according to the first embodiment of the disclosure.

FIG. 15 is a block diagram illustrating an example of a functional configuration for initial control of the control device 90. As shown in FIG. 15, the control device 90 includes a shoe shape determiner 911, a shoe information storage 912, a material determiner 913, and a dehumidification condition determiner 916, a sterilization condition determiner 917, and an operating mode setter 918 as functions for initial control. In addition, the camera 80, which is not a function of the control device 90 in a strict sense, is shown in FIG. 15.

The shoe shape determiner 911 performs shoe recognition of determining whether an image captured by the camera 80 is an image registered in the shoe information storage 912. When the image is not registered in the shoe information storage 912, that is, in response to non-registration, the shoe shape determiner 911 allows a shoe identification (ID), an image, and an operating mode to be automatically stored in the shoe information storage 912 subsequent to determination of the operating mode. In addition, as for shoes that have been previously accommodated in the shoe dryer 1, the shoe ID, the image, and the operating mode are previously registered in the shoe information storage 912, and thus in response to registration, the shoe shape determiner 911 automatically suggests the previously registered operating mode upon the shoe recognition.

The shoe information storage 912 assigns an image with a shoe ID of shoes displayed on the image, and stores the shoe ID to match the image and the operating mode (indicated as "existing" in the drawing). In addition, in response to non-registration from the shoe recognition, the shoe information storage 912 newly assigns a shoe ID, and stores the image together with an operating mode determined for the shoes or in a case when the user updates the operating mode, stores the image together with the updated operating mode for the shoes (indicated as "New/Updated" in the drawing).

The material determiner 913, in response to a user manually determining the material of non-registered shoes and inputting the material, determines the material according to the input determination result.

The dehumidification condition determiner 916 determines a dehumidification condition according to the material determination result of the material determiner 913. Specifically, the dehumidification condition determiner 916 determines the initial conditions for appropriate dehumidification drying (the number of rotations of the fan 31, the frequency of the compressor 325, etc.).

The sterilization condition determiner 917 determines the conditions of the sterilization unit 40 according to the material determination result of the material determiner 913. Specifically, the sterilization condition determiner 917 determines initial operating conditions (values of current and voltage, etc.) appropriate for the sterilization unit 40.

The operating mode setter 918 suggests the conditions determined by the dehumidification condition determiner 916 and the sterilization condition determiner 917 to the user, and sets the operating mode according to a user manipulation responsive to the suggested conditions. When the user desires another operating mode and manually updates the operating mode, the operating mode setter 918 sets the updated operating mode and stores the operating mode in the shoe information storage 912.

Figure 16:
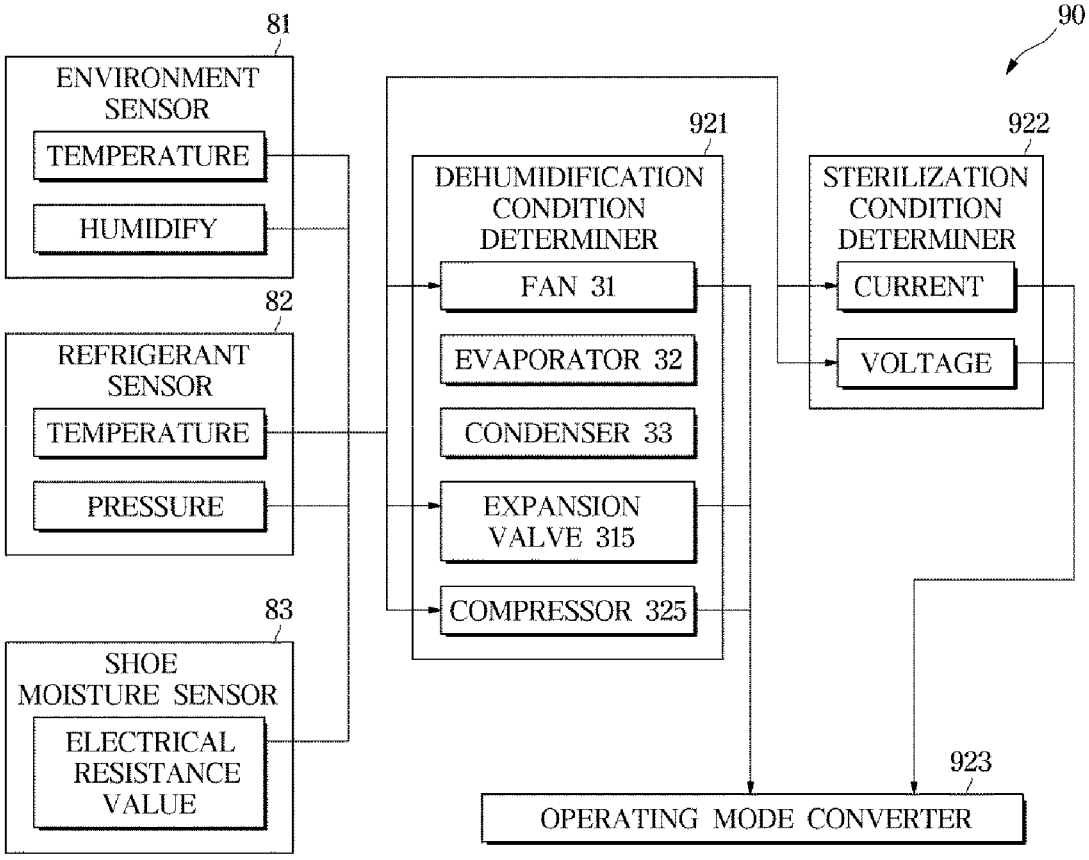
FIG. 16 is a block diagram illustrating an example of a functional configuration for control during operation of the control device of the shoe dryer according to the first embodiment of the disclosure.

FIG. 16 is a block diagram illustrating an example of a functional configuration for control during operation of the control device 90. As shown in FIG. 16, the control device 90 includes a dehumidification condition determiner 921, a sterilization condition determiner 922, and an operating mode converter 923 as functions for control during operation. FIG. 16 shows an environmental sensor 81, a refrigerant sensor 82, and a shoe moisture sensor 83, which are not functions of the control device 90 in a strict sense.

The environmental sensor 81 is a sensor that measures the temperature and humidity of the shoe receiving portion 20. The refrigerant sensor 82 is a sensor that measures the temperature and pressure of the refrigerant related to dehumidification control. The shoe moisture sensor 83 is a sensor that measures moisture with electrical resistance by making an electrode contact with shoes.

The dehumidification condition determiner 921 estimates the state of the refrigerant according to the values of the environmental sensor 81, the refrigerant sensor 82, and the shoe moisture sensor 83, and controls the dehumidification drying condition (the number of rotations of the fan 31, the frequency of the compressor 325, and the opening degree of the expansion valve 315).

The sterilization condition determiner 922 controls an operating condition (values of current, voltage, etc.) suitable for the temperature and humidity of the shoe receiving portion 20 according to the values of the environmental sensor 81, the refrigerant sensor 82, and the shoe moisture sensor 83.

The operating mode converter 923 changes the operating mode according to the conditions determined by the dehumidification condition determiner 916 and the sterilization condition determiner 917. In addition, the operating mode converter 923 may stop the operation according to the conditions determined by the dehumidification condition determiner 916 and the sterilization condition determiner 917.

Figure 17:
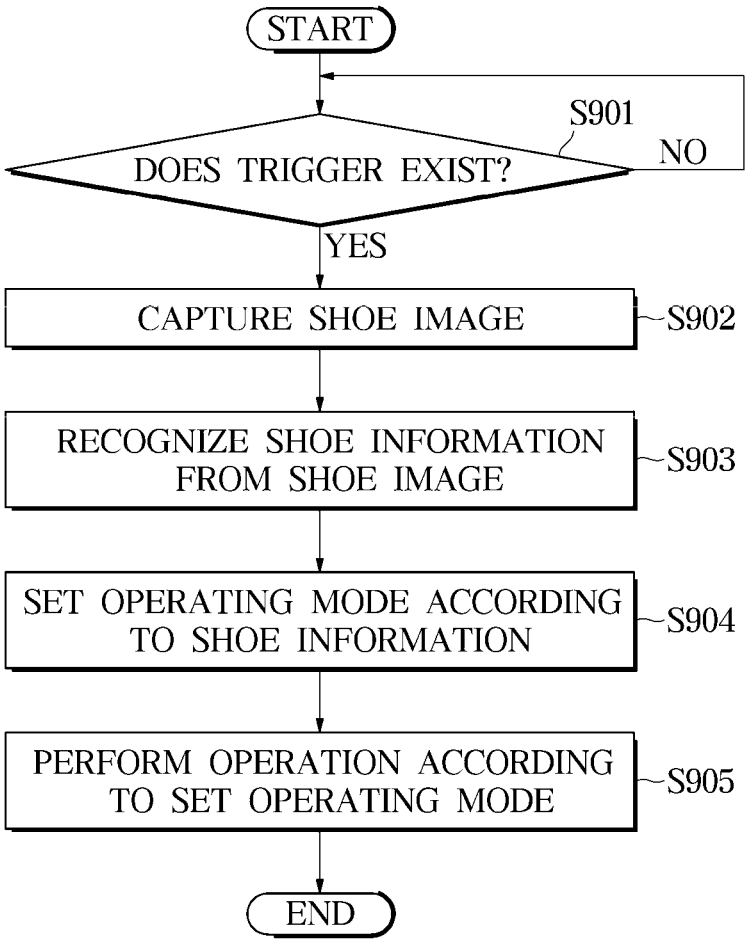
FIG. 17 is a flowchart showing an example of operations of the control device for the shoe dryer according to the first embodiment of the disclosure.

FIG. 17 is a flowchart showing an example of operations of the control device 90. Here, the example of operations is an example of operations at a time of initial control, and the image captured by the camera 80 is a shoe image. In addition, the camera 80 constantly captures the shoe image, and in response to existence of a change between frames of a still image, the control device 90 determines that a state change exists and starts the image recognition process, as a default. However, when transmission throughput of image data is not sufficient, a central processing unit (CPU) processing image data is powerless, and images are not able to be captured constantly, image capturing may be preferably started by a certain trigger. The following description is made in relation to an example in which image capturing is started by a trigger.

The control device 90 first determines whether a trigger for capturing a shoe image exists (S901). Here, the trigger may include detecting, by a sensor, except for the camera 80, a change of a state representing that a timer has detected the elapse of a certain time (for example, detecting, by a door switch, the door 11 being closed, detecting, by a weight sensor, shoes being accommodated into the partition 21 of the shoe receiving portion 20), and receiving an instruction from a user (for example, receiving an instruction to start an operation after the door 11 is closed). The control device 90 returns to operation S901 in response to determining no trigger, and performs operation S902 in response to determining existence of a trigger.

As such, in response to determining existence of a trigger for capturing a shoe image in operation S901, the control device 90 captures an image of shoes accommodated in the partition 21 of the shoe receiving portion 20 by the camera 80 (S902). Specifically, the control device 90 transmits a signal instructing the camera 80 to capture an image, and the camera 80 captures the shoe image.

Next, the control device 90 recognizes shoe information from the shoe image captured by the camera 80 in operation S902 (S903). Specifically, the shoe shape determiner 911 obtains the shoe image from the camera 80, and recognizes shoe information by, for example, image matching processing. In this case, when the shoe image obtained from the camera 80 is an image stored in the shoe information storage 912, the shoe shape determiner 911 recognizes a shoe ID as the shoe information. On the other hand, when the shoe image acquired from the camera 80 is not stored in the shoe information storage 912, the material determiner 913 recognizes material input by the user as the shoe information.

Subsequently, the control device 90 sets an operating mode according to the shoe information recognized in operation S903 (S904). Specifically, when the shoe image acquired from the camera 80 is an image stored in the shoe information storage 912, the operating mode setter 918 sets the operating mode that is matched with the shoe ID. On the other hand, when the shoe image acquired from the camera 80 is not stored in the shoe information storage 912, the control device 90 determines a humidification condition and a sterilization condition based on definition information defined by the dehumidification condition determiner 916 and the sterilization condition determine 917 and indicating material recognized by the material determiner 913 and indicating which dehumidification and sterilization conditions are appropriate for which material. Then, the operating mode setter 918 sets the operating mode according to the determined dehumidification condition and sterilization condition.

Finally, the control device 90 performs operation on the shoe dryer 1 according to the operating mode set in operation S904 (S905). Specifically, the control device 90 transmits a signal instructing the operation in the set operating mode to each component of the shoe dryer 1.

Here, in operations S904 and S905, the operating mode according to the shoe information recognized from the shoe image is set, and the shoe dryer 1 is operated with the operating mode, but this is only an example. Any processing may be performed using the shoe information recognized from the shoe image.

Figure 18:
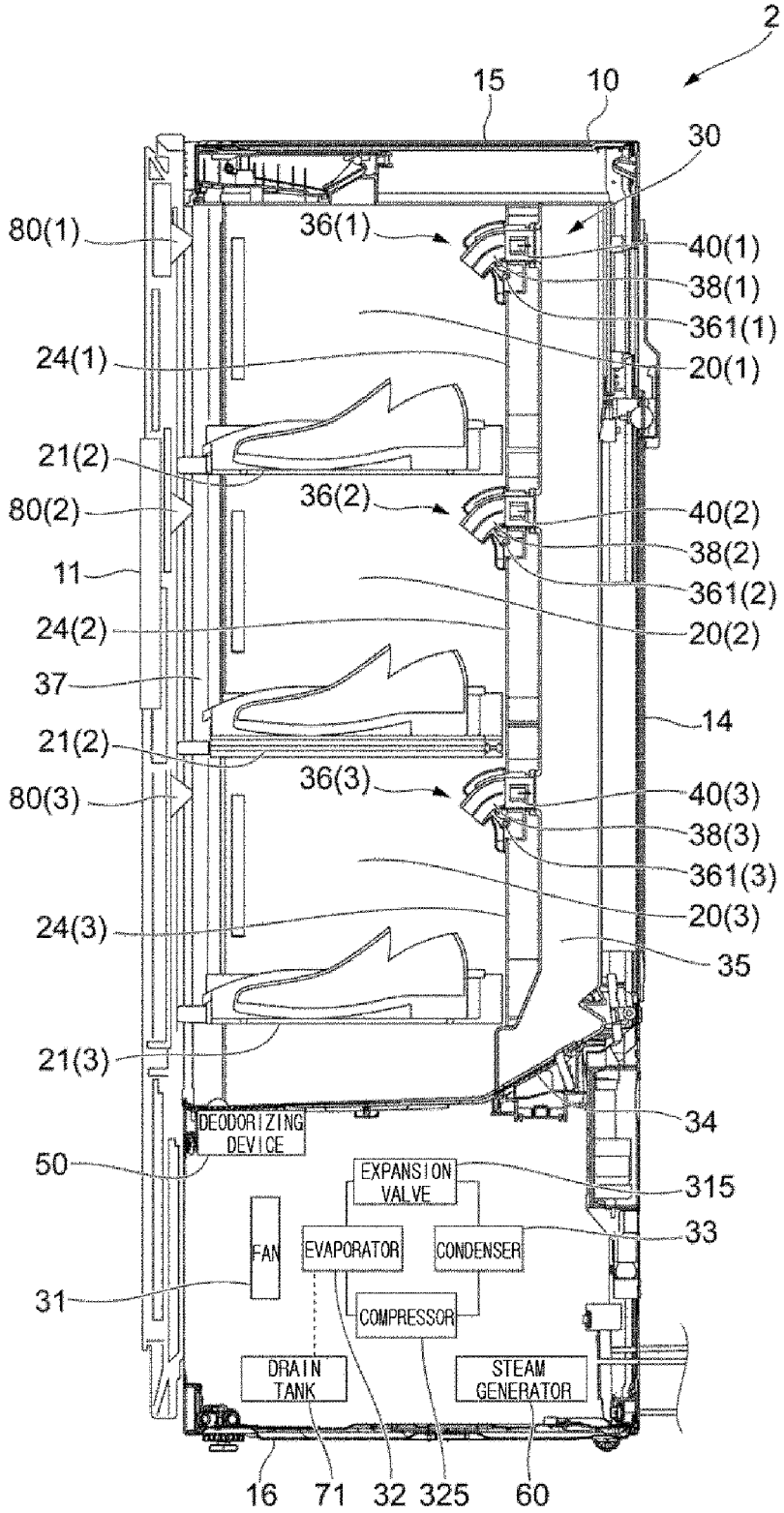
FIG. 18 is a side view illustrating a shoe dryer according to the second embodiment of the disclosure.

FIG. 18 is a side view illustrating a shoe dryer 2 according to the second embodiment. A perspective view showing the external appearance of the shoe dryer 2 according to the second embodiment is the same as shown in FIG. 1, and the front view of the shoe dryer 2 according to the second embodiment is the same as FIG. 3.

Referring to FIG. 18, the shoe dryer 2 according to the embodiment includes a main body 10 constituting an external appearance. The configuration of the main body 10 is the same as that described in the first embodiment.

In addition, as shown in FIG. 18, the shoe dryer 2 according to the embodiment is provided with shoe receiving portions 20(1) to 20(3) to receive shoes. Here, the shoe receiving portions 20(1) to 20(3) are described, but may be simply described as a shoe receiving portion 20 unless needed to be distinguished from each other. In addition, although three shoe receiving portions 20 are shown in the drawing, one, two, or four or more shoe receiving portions 20 may be provided. The configuration of the shoe receiving portion 20 and the wall surfaces provided for the shoe receiving portion 20 are the same as those described in the first embodiment.

In addition, as shown in the drawing, the shoe dryer 2 according to the embodiment has a circulation flow path 30 for dehumidifying and drying the shoe receiving portion 20 by circulating air in the main body 10. In addition, the circulation flow path 30 includes a fan 31, an evaporator 32, a condenser 33, a discharge flow path 34, a rear flow path 35, blowing units 36(1) to 36(3), and a front flow path 37. Since the circulation flow path 30 according to the second embodiment differs from the circulation flow path 30 according to the first embodiment only with regard to the blowing units 36(1) to 36(3), the following is described only on the blowing unit 36 (1) to 36(3).

The blowing units 36(1) to 36(3) are provided on the rear wall surfaces 24(1) to 24(3) of the shoe receiving portions 20(1) to 20(3), respectively, and serve to blow air from the rear flow path 35 toward the shoes accommodated in the partitions 21(1) to 21(3). Here, the blowing units 36(1) to 36(3) are described, but may be simply described as a blowing unit 36 unless needed to be distinguished from each other. In addition, although three blowing units 36 are shown in the drawing because three shoe receiving portions 20 are provided, the number of blowing units 36 may be changed according to the number of the shoe receiving portions 20. Further, the position of the blowing unit 36 is not limited to the rear wall surface 24, and the blowing unit 36 may be provided on other wall surfaces, such as the left wall surface 22, the right wall surface 23, and the ceiling (not shown).

In addition, in the second embodiment, the blowing units 36(1) to 36(3) each have a wind direction adjustment function to adjust the wind direction of the blowing nozzles 38(1) to 38(3). Such a wind direction adjustment function is realized by the driving units 361(1) to 361(3) that rotate the blowing nozzles 38(1) to 38(3), respectively, within a predetermined range about the rotation axis corresponding thereto. Here, the blowing nozzles 38(1) to 38(3) and the driving units 361(1) to 361(3) are described, but unless needed to be distinguished from each other, may be simply described as a blowing nozzle 38 and a driving unit 361. In addition, although three blowing nozzles 38 and three driving units 361 are shown in the drawing because three shoe receiving portions 20 are provided, the number of the blowing nozzles 38 and the driving units 361 may be changed according to the number of the shoe receiving portions 20. In the embodiment, the blowing unit 36 is provided as an example of a blowing portion.

Figure 19:
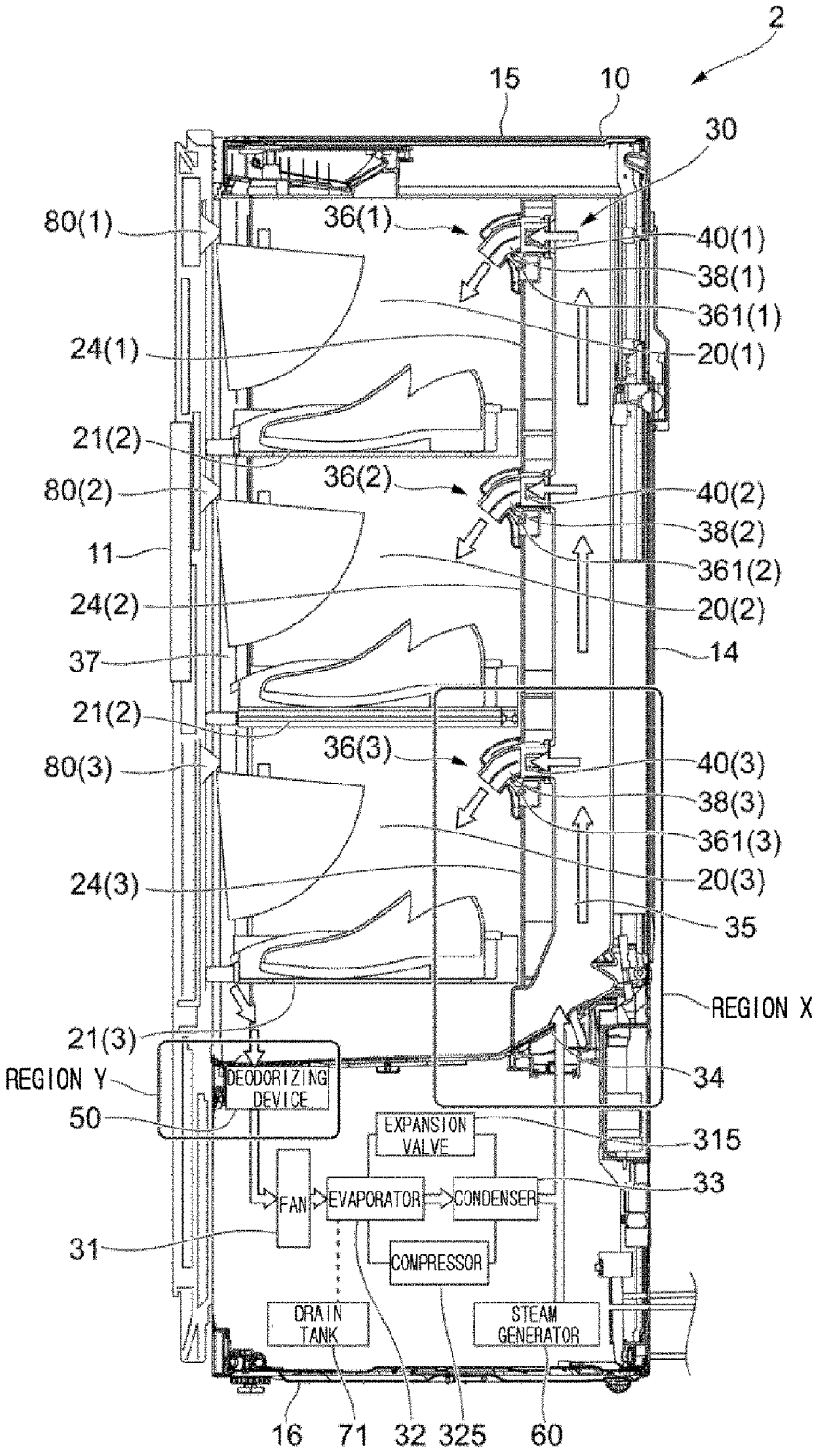
FIG. 19 is a side view illustrating the shoe dryer according to the second embodiment of the disclosure, which shows a flow of wind in a circulation flow path and a photographing range of a camera to overlap each other.

In FIG. 19, the flow of wind (air current) in the circulation flow path 30 is indicated by a white arrow. Here, the white arrow from a deodorizing device 50 to the evaporator 32 indicates a flow of air with high humidity, and the white arrow from the evaporator 32 to the condenser 33 indicates a flow of air with low humidity, the white arrow from the condenser 33 or steam generator 60 to the rear flow path 35 indicates a flow of air with high temperature. In addition, in the circulation flow path 30, the fan 31 is provided on the upstream side of the evaporator 32, but the position of the fan 31 is not limited thereto. The fan 31 may be provided on the downstream side of the condenser 33 or may be provided in each blowing unit 36.

In addition, as shown in FIG. 18, the shoe dryer 2 according to the embodiment includes sterilization units 40(1) to 40(3), deodorizing devices 50, a steam generator 60, a drain tank 71, and a water supply tank 72, which are the same as those described in the first embodiment.

In addition, as shown in FIG. 18, the shoe dryer 2 according to the embodiment includes cameras 80(1) to 80(3) and a control device 90.

The cameras 80(1) to 80(3) are provided on the wall surfaces of the shoe receiving portions 20(1) to 20(3), respectively, and capture an image of the shoe (a photograph of the shoe) accommodated in the shoe receiving portions 20(1) to 20(3). Here, the wall surface may refer to a wall surface constantly forming a wall surface of the shoe receiving portion 20 or may refer to a wall surface temporarily forming a wall surface of the shoe receiving portion 20. Examples of the former include the left wall surface 22, the right wall surface 23, and the rear wall surface 24 of the shoe receiving portion 20, as well as a ceiling surface (not shown). Examples of the latter may include an inner surface of the door 11 that becomes the front wall surface of the shoe receiving portion 20 when the door 11 is closed. In the drawings, a case where the cameras 80(1) to 80(3) are installed on the inner surface of the door 11 is shown. In addition, the camera 80 may acquire many-sided images of the shoes using a mirror.

In FIG. 19, the photography ranges by the cameras 80(1) to 80(3) are shown in the shape of a fan centered on the cameras 80(1) to 80(3). Here, the cameras 80(1) to 80(3) are described, but may be simply described as a camera 80 unless needed to be distinguished from each other. Although three cameras 80 are shown in the drawings because three shoe receiving portions 20 are provided, the number of cameras 80 may be changed according to the number of the shoe receiving portions 20.

The camera 80 may capture an image of a product tag or a barcode that contains information about the shoes (shoe information). In this case, the camera 80 may be provided on the outer side of the main body 10 without needing to be provided on the wall surface of the shoe receiving portion 20 in the main body 10.

In the embodiment, the camera 80 is provided as an example of an image acquisition portion that acquires an image through photographing.

The control device 90 determines shoe information from an image captured by the camera 80. Here, the shoe information includes, for example, the type, shape, size, material of the shoe, and the position of the shoes into which foots are inserted. When the image captured by the camera 80 is a shoe image, the shoe information may be determined by, for example, image matching processing between the captured image and a previously registered image. In addition, when the image captured by the camera 80 is an image of a product tag or a barcode, the shoe information may be determined by, for example, character recognition processing of characters written on the product tag or analysis processing of information represented in barcodes. Then, the control device 90 sets an operating mode and a wind direction of the blowing nozzle 38 in the shoe dryer 1 according to the determined shoe information. The operating mode may include at least one of the strength of sterilization by the sterilization unit 40, the temperature of the air blown by the blowing unit 36, the wind volume of the air blown by the blowing unit 36, the wind speed of the air blown by the blowing unit 36, and the operating time of the shoe dryer 1, but is not limited thereto.

For example, at a time of initial control, the control device 90 registers a result of determining the size of the shoes and the position of the shoes into which foots are inserted and a result of determining the material by the user from the image captured by the camera 80. Then, the control device 90 automatically determines an initial condition of dehumidification drying (the number of rotations of the fan 31, the frequency of the compressor 325, and the like), an initial operating condition of the sterilization unit 40 (the current or voltage value), and a driving condition of the blowing nozzle 38.

In addition, at a time of control during operation, the control device 90 determines a condition of dehumidification drying (the number of rotations of the fan 31, the frequency of the compressor 325, and the opening degree of the expansion valve 315), an operating condition (the current or voltage value) of the sterilization unit 40, and a driving condition of the blowing nozzle 38 according to a value of a sensor provided in the main body 10. Then, the control device 90 controls the shoe dryer 1 to automatically operate with the determined condition or stop operation.

In the embodiment, an operating mode is used as an example of the operating condition, and the control device 90 is provided as an example of a control portion that controls the operating condition of the shoe dryer 1 based on shoe information contained in an image and a control portion that controls the blowing direction of the blowing portion based on shoe information contained in an image.

Therefore, shoe care may be performed while suppressing shoes from being damaged due to sterilization or heat.

Further, the control device 90 may be implemented in software or hardware. When implemented in software, the control device 90 may include a central processing unit (CPU), a random-access memory (RAM), a read-only memory (ROM), and the like, and for example, the CPU may read a program stored in the ROM into RAM and execute the program. Alternatively, the software loaded into the RAM in a system equipped with an operating system (OS) may be software stored in an external storage device, such as a hard disk drive (HDD) or a secure digital SD (registered trademark) card.

In addition, all the configurations described with reference to FIGS. 5 to 14B in the first embodiment are applicable to the second embodiment.

Hereinafter, functions and components of the shoe dryer 2 will be described in detail.

(Adjustment of Wind Direction of Blowing Unit Based on Image of Camera)

In order to dry the shoes, air needs to be blown to the toes of the shoes. However, when the extension nozzle 381 is absent or when the blowing nozzle 38 is fixed, the wet shoes may not be dried or a longer drying time may be required depending on the shoe size or the position of the shoe. Accordingly, the position information of the mouth portions of the shoes into which foots are inserted is recognized from the image of the shoe, and the wind direction of the blowing nozzle 38 is adjusted to face toward the mouth portions of the shoes. Such a configuration may efficiently dry the inside of the shoe in a short time, but also suppress the shoe from being overdried due to blowing air to an undesired position, such as the outside of the shoe.

Figure 20:
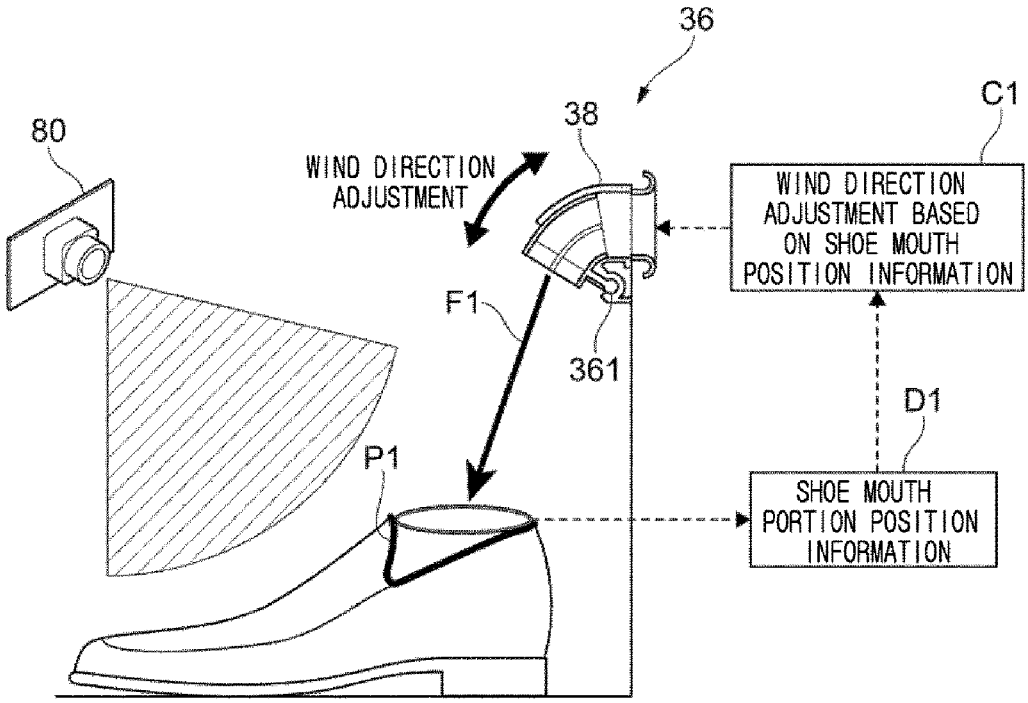
FIG. 20 is a schematic diagram illustrating adjustment of a wind direction of a blowing nozzle based on a show image.

FIG. 20 is a schematic diagram illustrating adjustment of a wind direction of the blowing nozzle 38 based on a shoe image. In this case, first, the camera 80 captures an image (a shoe image) of the shoe accommodated in the shoe receiving portion 20. The shoe image includes an image of a shoe mouth portion P1. Accordingly, position information D1 of the shoe mouth portion P1 is calculated from the shoe image. Here, as the position information D1 of the shoe mouth portion P1 may be provided using the coordinates of the center of a circle or an ellipse that is approximated to the shape of an upper surface of the shoe mouth portion P1. Then, the blowing unit 36 performs a wind direction adjustment C1 on the blowing nozzle 38 according to the position information D1 of the shoe mouth portion P1 such that air is blown toward the shoe mouth portion P1 as indicated by an arrow F1.

In addition, the blowing unit 36 may perform the wind direction adjustment C1 mechanically or manually. The former will be described below. For the latter, the user may designate the shoe mouth portion P1 or any other position rather than the shoe mouth portion P1 for the shoe image on the touch panel 18 (see FIG. 14A), and select the wind direction adjustment angle.

Further, the camera 80 may capture an image of a product tag or barcode that contains information about the shoes (shoe information), and obtain the position information D1 of the shoe mouth P1 from the image. In this case, the camera 80 may be provided on the outer side of the main body 10 without needing to be provided on the wall surface of the shoe receiving portion 20 in the main body 10. That is, the camera 80 may be provided in any place inside or outside the main body 10. Further, a plurality of the cameras 80 may be installed inside or outside the main body 10.

Here, a method of mechanically performing the wind direction adjustment C1 by the blowing unit 36 will be described in detail.

For example, the blowing unit 36 performs wind direction adjustment C1 on the blowing nozzle 38 in synchronization with a pulse power. Specifically, the blowing unit 36 operates the blowing nozzle 38 by designating the number of rotations of a stepping motor, etc., in units of pulses according to a result of determining the position of the shoe mouth portion P1, so that the wind direction adjustment C1 toward the shoe mouth portion P1 is performed. In this case, in the initial operation, the blowing nozzle 38 may be returned to a home position (an initial value) regardless of the determination result, and start operation. This is because when the direction of the blowing nozzle 38 is out of position due to a manipulation of storing shoes, etc., there is a possibility that the wind direction adjustment C1 toward the shoe mouth portion P1 may fail even when the blowing nozzle 38 is operated according to the result of determining the position of the shoe mouth portion P1 based on the position, which is a displaced position.

As an example of the method of mechanically performing wind direction adjustment C1 by the blowing unit 36, there is a method of performing wind direction adjustment C1 using the driving unit 361 that operates according to the correlation between the movement amount and the driving voltage waveform, that is, the driving unit 361 that determines the movement amount according to the driving power waveform. A typical example of the driving unit 361 is a stepping motor as described above, but a direct current (DC) brushless motor, a synchronous motor, a reluctance motor, or the like may be used instead of the stepper motor. Here, the stepping motor, the DC brushless motor, the synchronous motor, the reluctance motor, or the like is an example of an electric motor that determines a movement amount according to a driving voltage waveform.

In addition, as an example of the method of mechanically performing the wind direction adjustment C1 by the blowing unit 36, there is a method of performing wind direction adjustment C1 using the driving unit 361 that is operated by controlling the current. As for the driving unit 361, a case in which a DC motor is operated on a combination of a plurality of voltage waveforms (square waves, triangle waves, and arbitrary waveforms having a DC bias, such as pulse width modulation (PMW)) may be considered.

In addition, as an example of the method of mechanically performing the wind direction adjustment C1 by the blowing unit 36, there is a method of performing the wind direction adjustment C1 by detecting the movement amount using an encoder and performing feedback control without using the correlation between the movement amount and the driving voltage waveform.

(Adjustment of Wind Direction of Blowing Unit Based on Information of Environmental Sensor)

Figure 21:
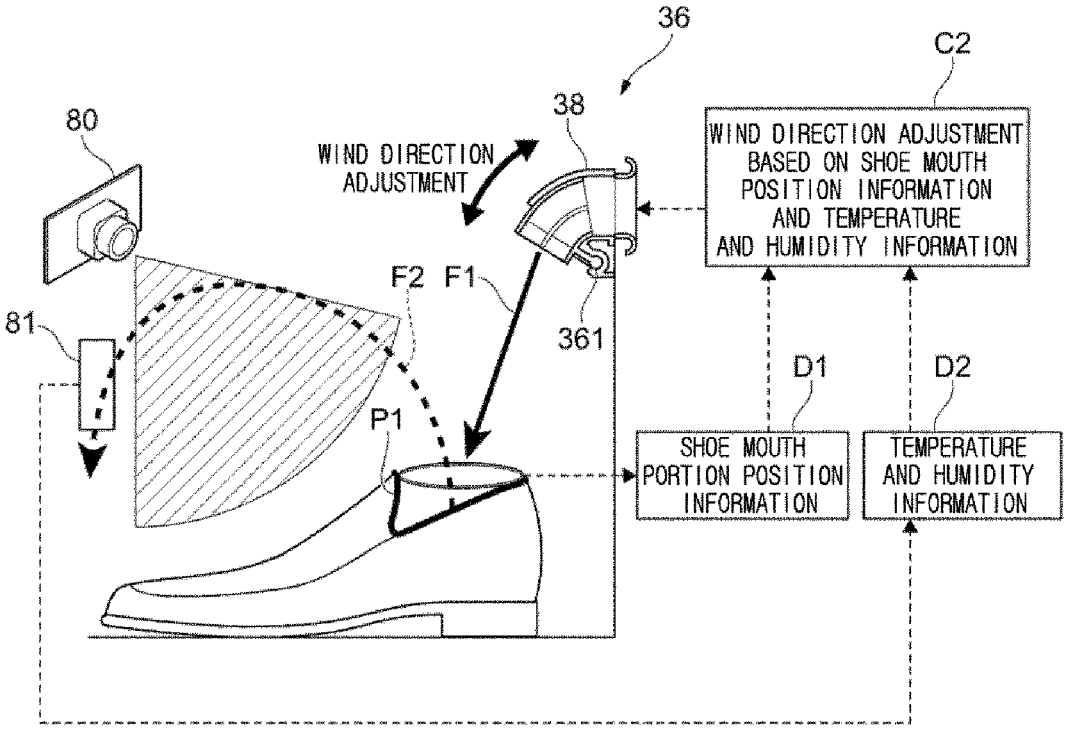
FIG. 21 is a schematic diagram illustrating adjustment of a wind direction of the blowing nozzle based on temperature and humidity information.

FIG. 21 is a schematic diagram illustrating adjustment of a wind direction of the blowing nozzle 38 based on temperature and humidity information. In this case, the shoe dryer 2 is provided with the environmental sensor 81 as an example of a temperature and humidity sensing device for sensing temperature and humidity. The environmental sensor 81 may be installed in any position in the circulation flow path 30, but may be provided in a flow path or on a wall surface passed by air flowing out of shoes as indicated by an arrow F2 in the main body 10. In addition to calculating the position information D1 of the shoe mouth portion P1 from the shoe image captured by the camera 80 as shown in FIG. 20, temperature and humidity information D2 is also output from the environmental sensor 81. Accordingly, the blowing unit 36 performs the wind direction adjustment C2 on the blowing nozzle 38 based on the position information D1 of the P1 and the temperature and humidity information D2.

Specifically, a dryness completion state of the shoe is checked according to the temperature and humidity information of the environmental sensor 81 installed in the main body 10, and when the drying of the shoe is completed, the wind direction of the blowing nozzle 38 is adjusted from the shoe mouth portion P1 to any other portion rather than the shoe mouth portion P1. In addition, preferably, the wind direction of the blowing nozzle 38 may be adjusted outside a range in which the wind does not reach the shoes.

A method of suppressing shoes from being overdried may adopt a method of injecting outside air into the main body 10 to maintain the humidity inside the main body 10 at a level similar to that of the outside air, or may adopt a method of humidifying the inside of the main body 10 to maintain the humidity inside the main body 10 at a level of 10% to 60%.

(Adjustment of Wind Volume and Wind Speed of Blowing Unit)

Next, adjustment of the wind volume and wind speed of air blown from the blowing nozzle 38 will be described. Here, it is assumed that the blowing unit 36 adjusts the wind volume and wind speed of air blown according to the angle of the blowing nozzle 38.

Figure 22A:
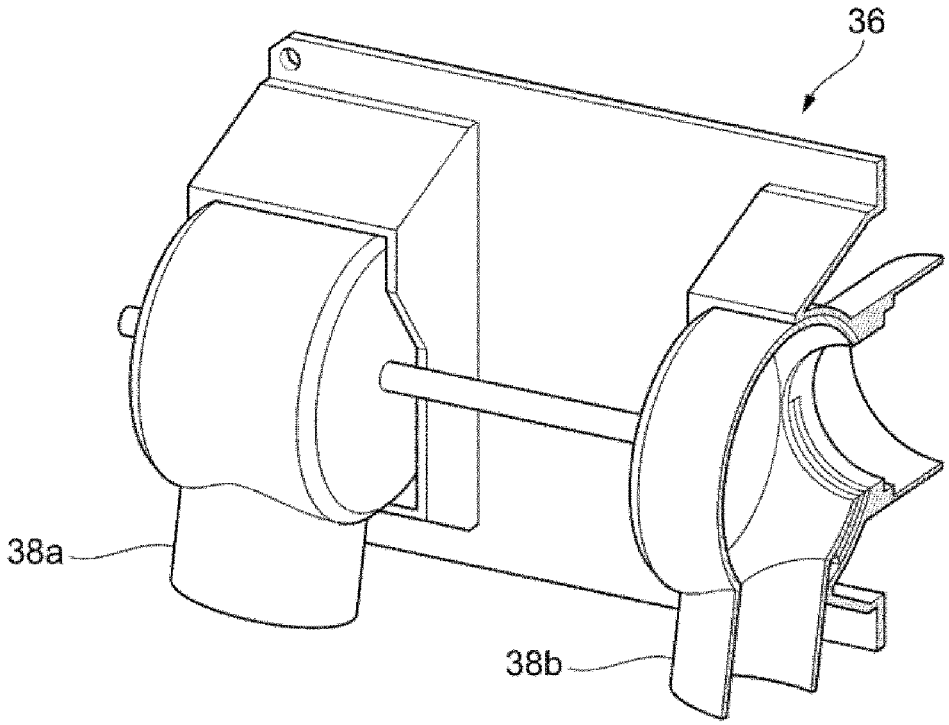
FIG. 22A is a perspective view illustrating a blowing unit when the angle of the blowing nozzle is set to an angle at which the blowing nozzle faces downward.
Figure 22B:
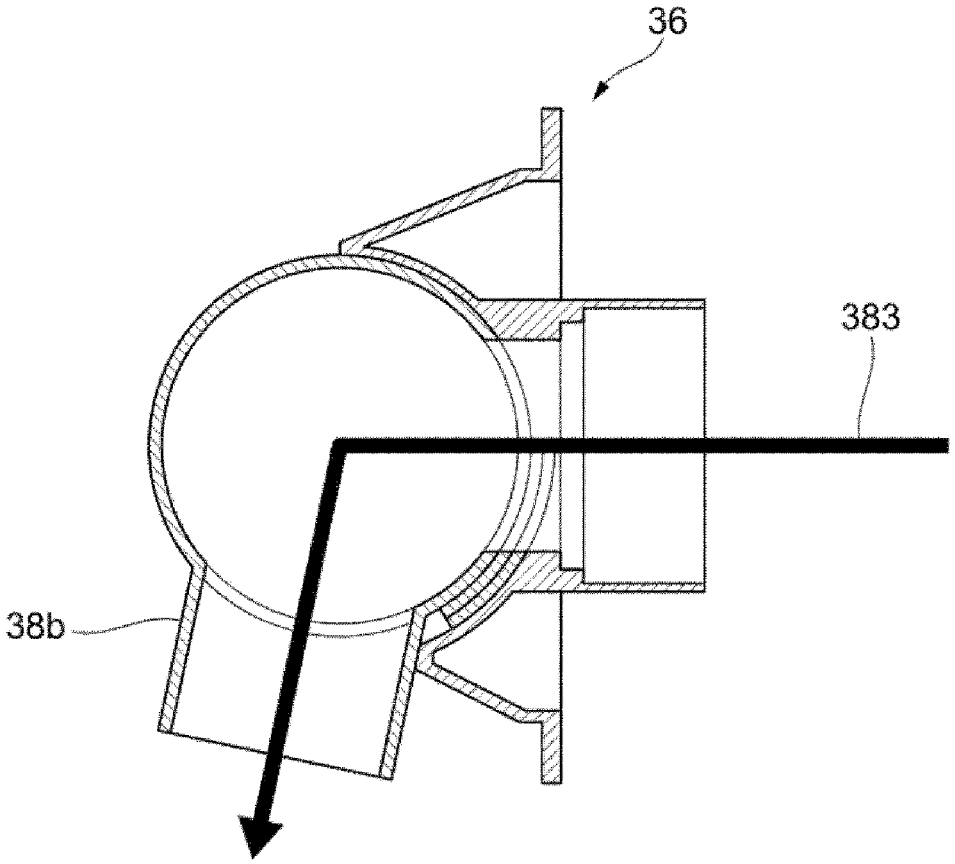
FIG. 22B is a side view illustrating the blowing unit shown in FIG. 22A.

FIG. 22A is a perspective view illustrating the blowing unit 36 when the angle of the blowing nozzle is set to an angle at which the blowing nozzle 38 faces downward, and FIG. 22B is a side view illustrating the blowing unit 36 shown in FIG. 22A. In the drawings, the blowing nozzle 38*b* is cut out and shown, and in FIG. 22B, the flow of wind is shown. In this case, as indicated by a thick arrow 383 in FIG. 22B, the wind volume and wind speed of air blown by the blowing nozzle 38*b* are increasing. In addition, although not shown, the same applies to the blowing nozzle 38*a*.

Figure 23A:
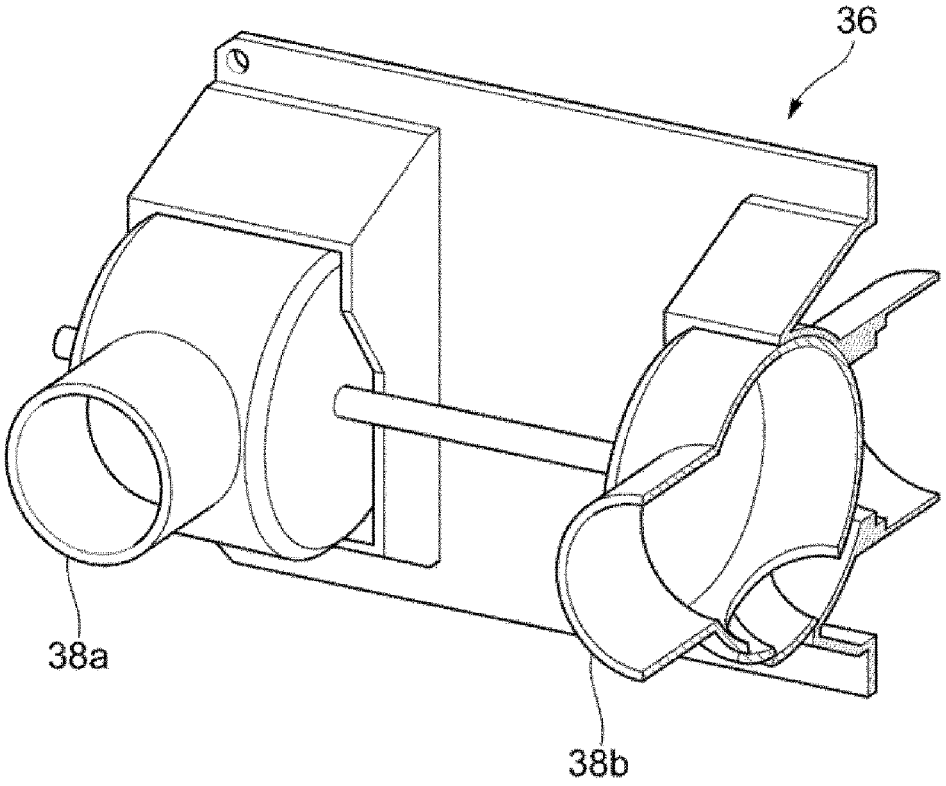
FIG. 23A is a perspective view illustrating the blowing unit when the angle of the blowing nozzle is set to an angle at which the blowing nozzle faces forward.
Figure 23B:
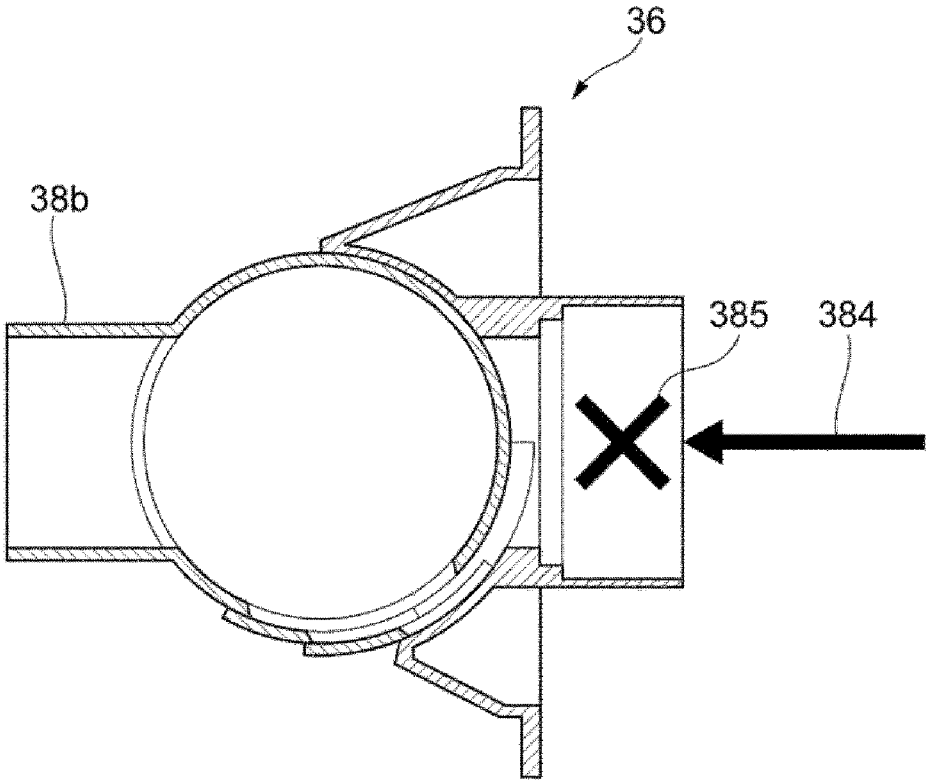
FIG. 23B is a side view illustrating the blowing unit shown in FIG. 23A.

FIG. 23A is a perspective view illustrating the blowing unit 36 when the angle of the blowing nozzle 38 is set to an angle at which the blowing nozzle 38 faces forward, and FIG. 23B is a side view illustrating the blowing unit 36 shown in FIG. 23A. In the drawings, the blowing nozzle 38*b* is cut out and shown, and the flow of wind is shown in FIG. 23B. In this case, as indicated by a thick arrow 384 and a x-mark 385 in FIG. 23B, air blowing from the blowing nozzle 38*b* is stopped. In addition, although not shown, the same applies to the blowing nozzle 38*a*.

Alternatively, when the angle of the blowing nozzle 38 is set to an angle between the angle shown in FIGS. 22A and 22B and the angle shown in FIGS. 23A and 23B, the air blowing from the blowing nozzle 38 is not stopped, and the wind volume and the wind speed of air blown from the blowing nozzle 38 decreases. That is, when the environmental sensor 81 shown in FIG. 21 detects completion of drying, the wind speed of air blown from the blowing nozzle 38 is adjusted to decrease or the air blowing from the blowing nozzle 38 is adjusted to stop, thereby suppressing shoes from being overdried.

In addition, the wind volume and the wind speed of air blown from the blowing nozzle 38 may be adjusted by a damper. Specifically, the wind volume and wind speed may be adjusted by providing a damper at an inside or an entrance of the blowing nozzle 38 and opening and closing the damper.

(Driving Method of Wind Direction Adjustment Device)

Figure 24:
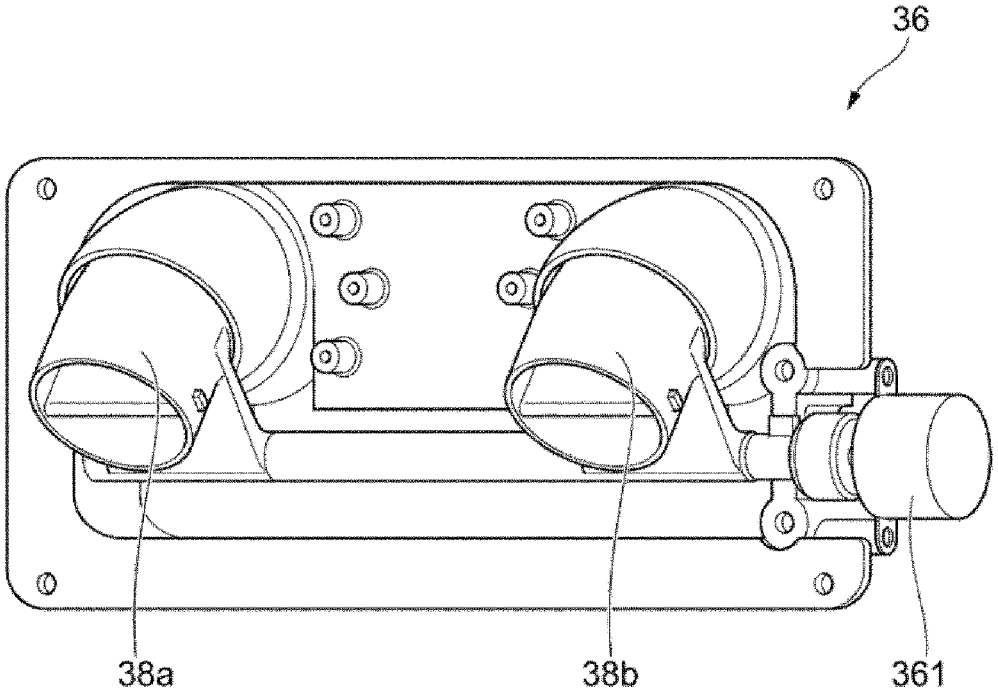
FIG. 24 is a perspective view illustrating the external appearance of the blowing unit driven by a first driving method.

FIG. 24 is a perspective view illustrating the external appearance of the blowing unit 36 driven by a first driving method.

As shown in FIG. 6, the blowing unit 36 includes the blowing nozzle 38*a* for blowing air to the right shoe and the blowing nozzle 38*b* for blowing air to the left shoe. In addition, unless needed to be distinguished from each other, the blowing nozzles 38*a* and 38*b* may be simply described as a blowing nozzle 38. Therefore, in other words, it may be referred that the blowing unit 36 is provided with two blowing nozzles 38 for one pair of shoes, and is capable of blowing air for each of the left and right shoes. In the embodiment, the blowing nozzle 38*a* is provided as an example of the first blowing nozzle that blows air toward the right shoe, and the blowing nozzle 38*b* is provided as an example of the second blowing nozzle that blows air toward the left shoe.

As described above, the blowing nozzle 38 is provided for each of the left and right shoes, so that air may be blown only to a desired part, thereby improving the efficiency of shoe care (sterilization, drying, etc.).

In addition, in the first driving method, the blowing unit 36 includes one driving unit 361. The driving unit 361 simultaneously drives the blowing nozzles 38*a* and 38*b* to adjust the wind directions of the blowing nozzles 38*a* and 38*b*.

In FIG. 24, the angle of the blowing nozzle 38 is set to a front oblique downward angle, but is not limited thereto.

Figure 25A:
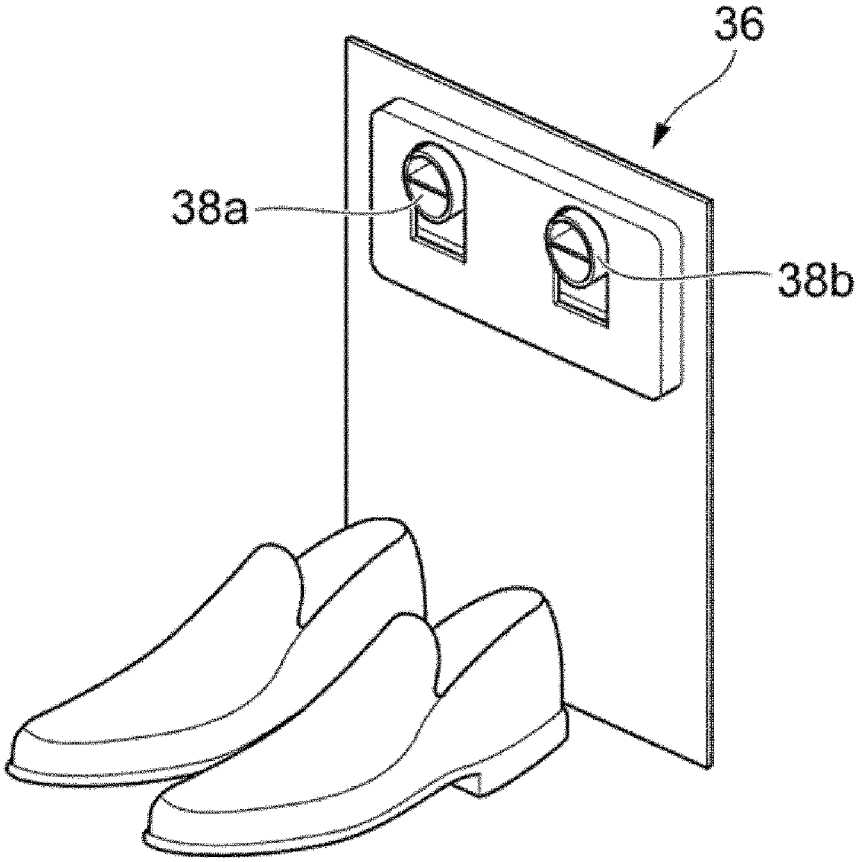
FIG. 25A is a perspective view illustrating a state in which the blowing nozzle is set to an angle at which the blowing nozzle is perpendicular to a rear wall surface of a shoe receiving portion.
Figure 25B:
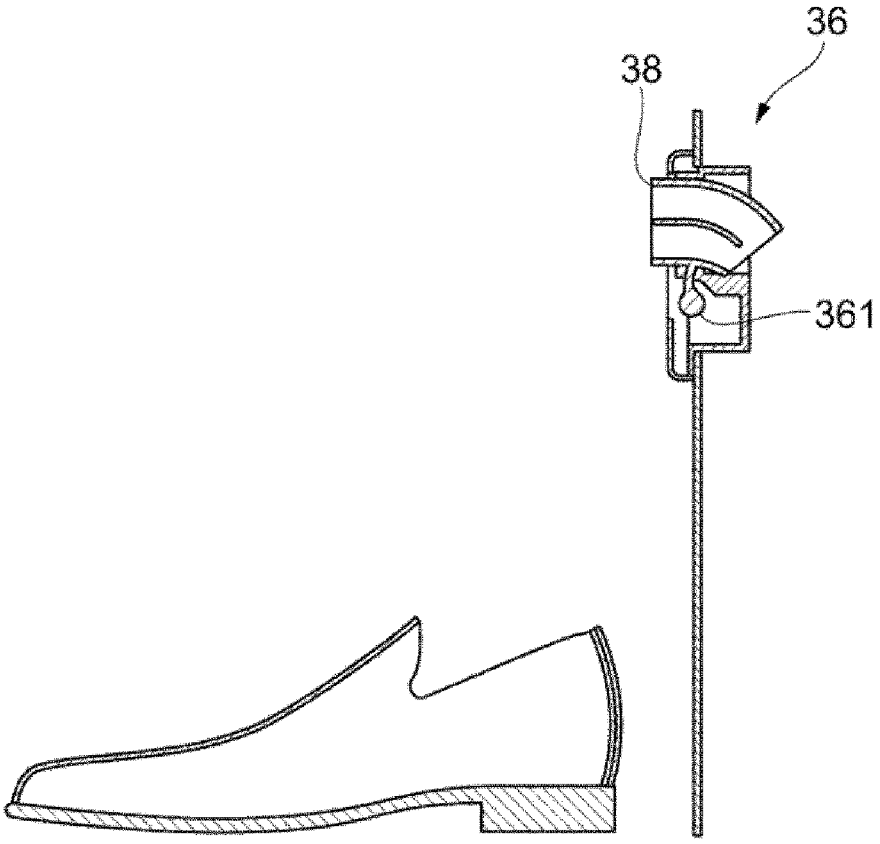
FIG. 25B is a side view illustrating the blowing nozzle shown in FIG. 25A.

FIG. 25A is a perspective view illustrating a state in which the blowing nozzle 38 is set to an angle at which the blowing nozzle 38 is perpendicular to the rear wall surface 24 of the shoe receiving portion 20, and FIG. 25B is a side view illustrating the blowing nozzle 38 shown in FIG. 25A. In this case, air is blown from the blowing nozzle 38 in a direction perpendicular to the rear wall surface 24 of the shoe receiving portion 20.

Figure 26A:
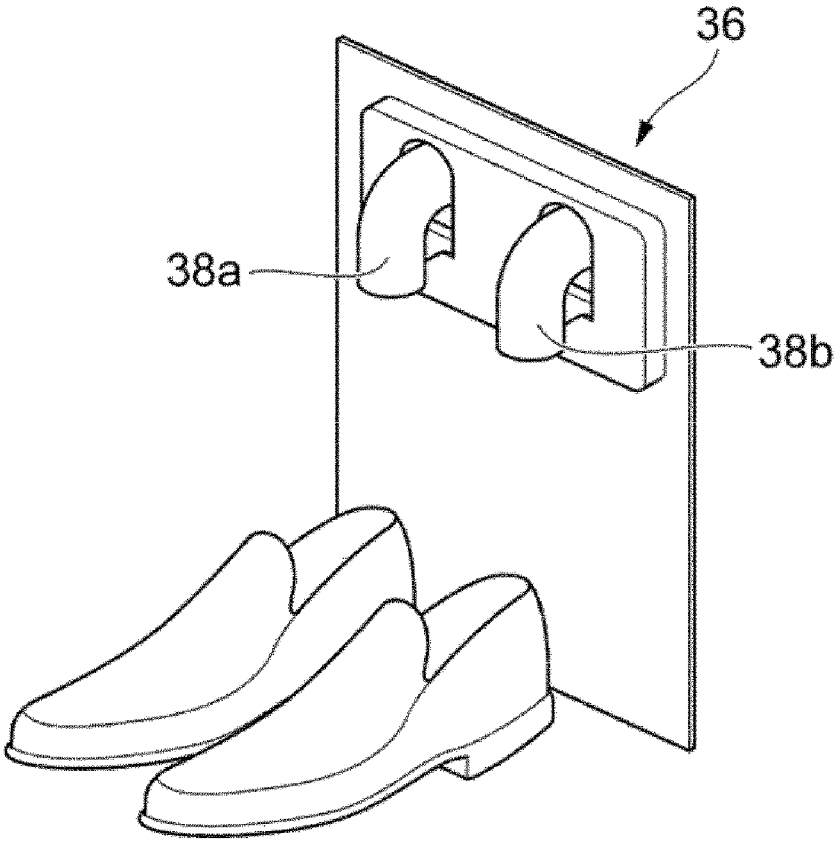
FIG. 26A is a perspective view illustrating a state in which the blowing nozzle is set to an angel at which the blowing nozzle is parallel to the rear wall surface of the shoe receiving portion while facing downward.
Figure 26B:
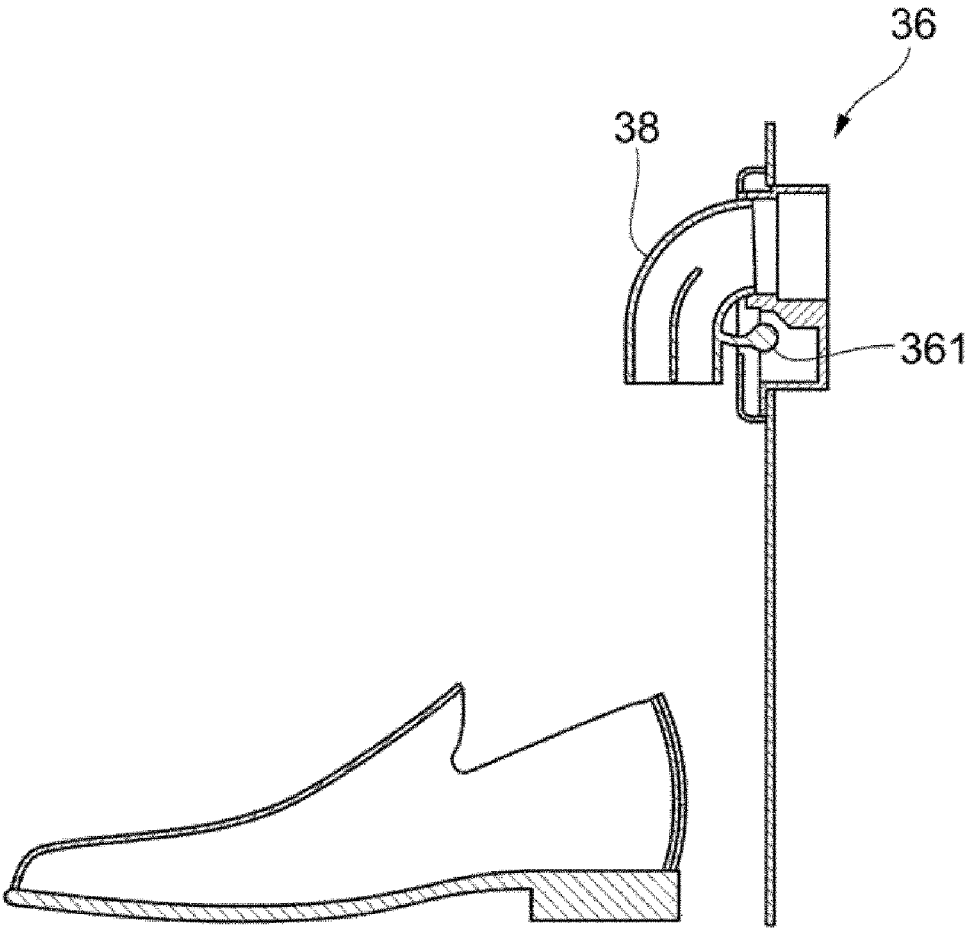
FIG. 26B is a side view illustrating the blowing nozzle shown in FIG. 26A.

FIG. 26A is a perspective view illustrating a state in which the blowing nozzle 38 is set to an angel at which the blowing nozzle 38 is parallel to the rear wall surface 24 of the shoe receiving portion 20 while facing downward, and FIG. 26B is a side view illustrating the blowing nozzle 38 shown in FIG. 26A. In this case, the air is blown from the blowing nozzle 38 in a downward direction parallel to the rear wall surface 24 of the shoe receiving portion 20.

In addition, the angle of the blowing nozzle 38 may be adjusted back and forth on a vertical surface perpendicular to the rear wall surface 24 of the shoe receiving portion 20 as described above, but is not limited thereto. For example, the angle of the blowing nozzle 38 may be adjusted to the left or right on a horizontal surface perpendicular to the rear wall surface 24 of the shoe receiving portion 20. Alternatively, the angle of the blowing nozzle 38 may be adjusted in a slanting manner on a surface that is perpendicular to the rear wall surface 24 of the shoe receiving portion 20 but is neither a vertical surface nor a horizontal surface perpendicular.

Figure 27:
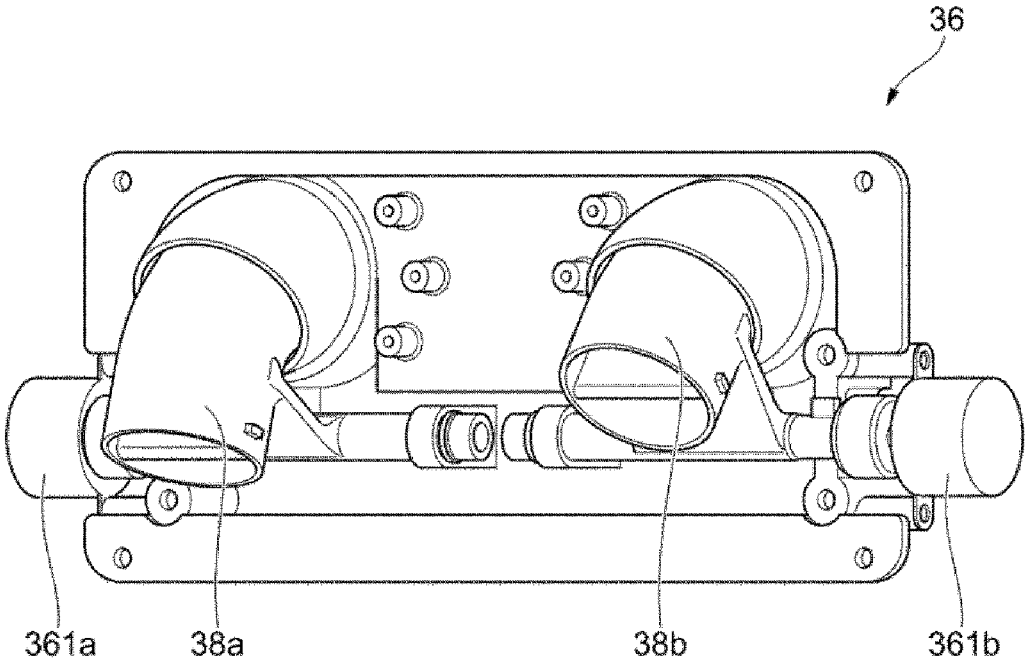
FIG. 27 is a perspective view illustrating the external appearance of the blowing unit driven by a second driving method.

FIG. 27 is a perspective view illustrating the external appearance of the blowing unit 36 driven by the second driving method.

As shown in FIG. 6, the blowing unit 36 is provided with the blowing nozzle 38*a* for blowing air to the right shoe and the blowing nozzle 38*b* for blowing air to the left shoe.

As described above, the blowing nozzle 38 is provided for each of the left and right shoes, so that air is blown only to a desired part, thereby improving the efficiency of shoe care (sterilization, drying, etc.).

Further, in the second driving method, the blowing unit 36 includes a driving unit 361*a* for driving the blowing nozzle 38*a* and a driving unit 361*b* for driving the blowing nozzle 38*b*. The driving unit 361*a* drives the blowing nozzle 38*a* to adjust the wind direction of the blowing nozzle 38*a*, and the driving unit 361*b* drives the blowing nozzle 38*b* to adjust the wind direction of the blowing nozzle 38*b*. That is, the wind direction of the blowing nozzle 38*a* and the wind direction of the blowing nozzle 38*b* are independently controlled.

In FIG. 27, the angle of the blowing nozzle 38 is set to a front diagonal downward angle, but is not limited thereto. The angle of the blowing nozzle 38 is set to be an angle perpendicular to the rear wall surface 24 of the shoe receiving portion 20 such that air of the blowing nozzle 38 is blown in a direction perpendicular to the rear wall surface 24 of the shoe receiving portion 20. Alternatively, the angle of the blowing nozzle 38 is set to an angle at which the blowing nozzle 38 faces in a downward direction parallel to the rear wall surface 24 of the shoe receiving portion 20 such that air of the blowing nozzle 38 is blown in a downward direction parallel to the rear wall surface 24 of the shoe receiving portion 20.

In addition, the angle of the blowing nozzle 38 may be adjusted back and forth on a vertical surface perpendicular to the rear wall surface 24 of the shoe receiving portion 20 as described above, but is not limited thereto. For example, the angle of the blowing nozzle 38 may be adjusted to the left or right on a horizontal surface perpendicular to the rear wall surface 24 of the shoe receiving portion 20. Alternatively, the angle of the blowing nozzle 38 may be adjusted in a slanting manner on a surface that is perpendicular to the rear wall surface 24 of the shoe receiving portion 20 but is neither a vertical surface nor a horizontal surface.

(Relationship Between Position of Shoe And Position of Blowing Unit)

Figure 28A:
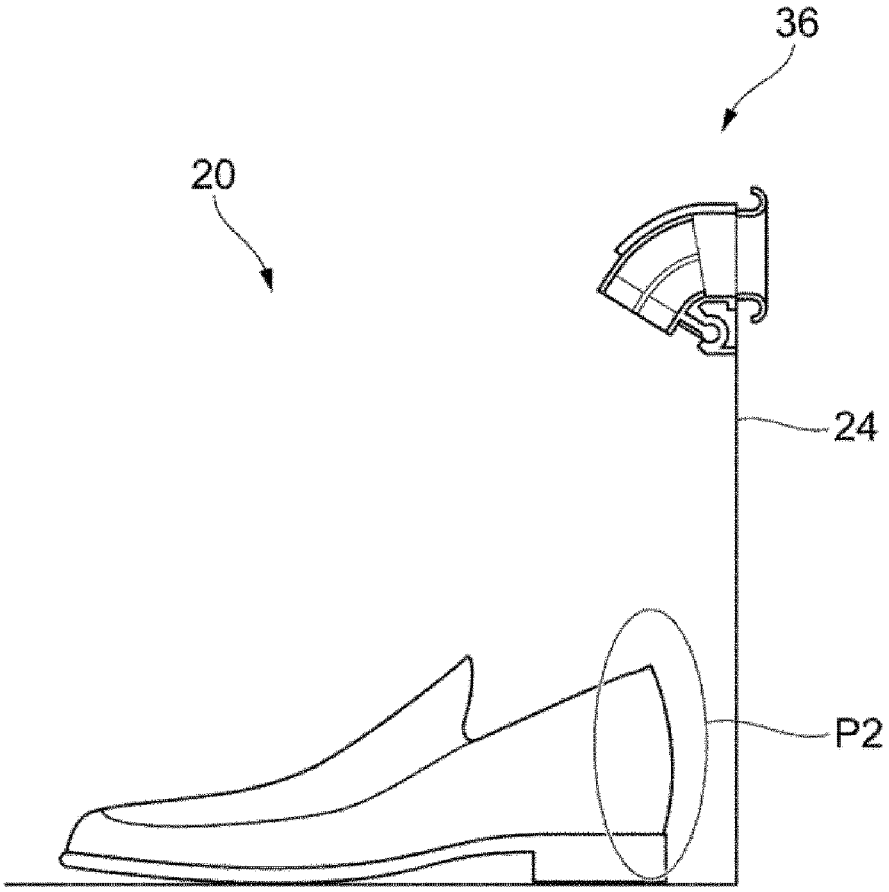
FIG. 28A is a view showing an example of a positional relationship between a shoe and the blowing unit.
Figure 28B:
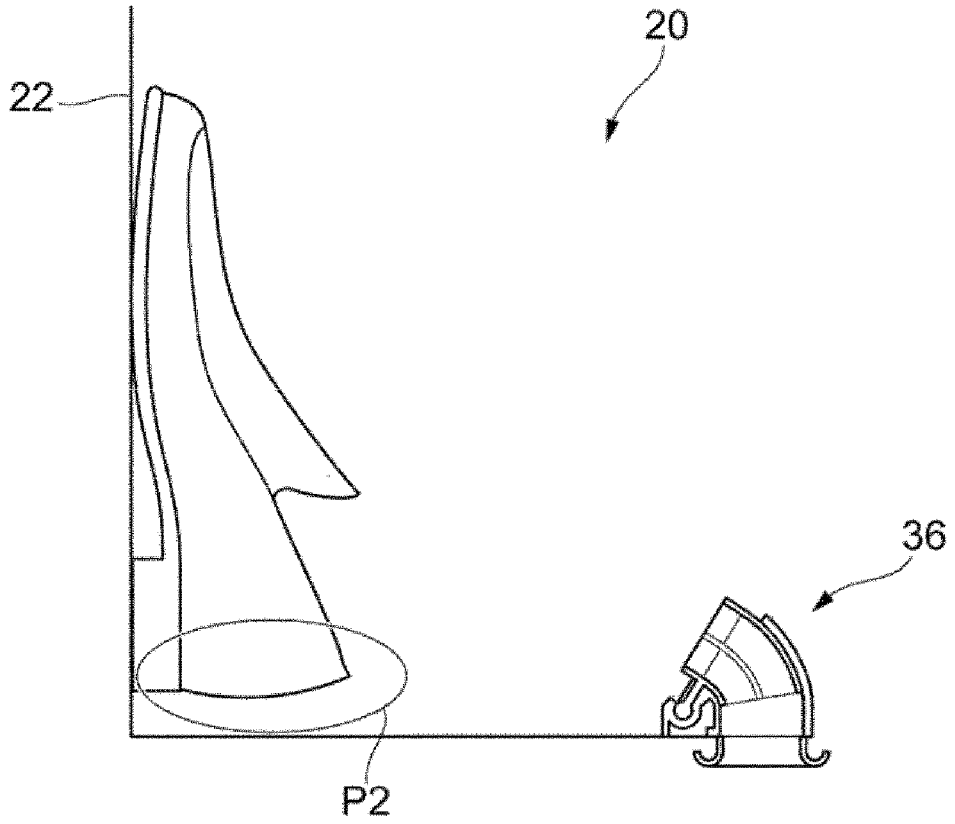
FIG. 28B is a view showing an example of a positional relationship between a shoe and the blowing unit.

FIGS. 28A and 28B are views showing an example of positional relationship between a shoe and the blowing unit 36.

FIG. 28A is an example of a case in which the shoe is placed horizontally with a heel portion P2 of the shoe disposed adjacent to the rear wall surface 24 of the shoe receiving portion 20. In this case, the blowing unit 36 may be installed on the rear wall surface 24 of the shoe receiving portion 20.

In addition, FIG. 28B is an example of a case in which the shoe is hung upright on the left wall surface 22 of the shoe receiving portion 20 with the heel portion P2 of the shoe oriented downward. In this case, the blowing unit 36 may be installed on the lower surface of the shoe receiving portion 20.

That is, the blowing unit 36 may be installed on a wall surface of the shoe receiving portion 20 adjacent to the heel portion P2 of the shoe. In other words, it can be seen that the blowing unit 36 is provided on a wall surface of the shoe receiving portion 20 facing the heel portion of the shoe. In addition, in FIGS. 20 and 21, the blowing unit 36 is provided above and behind the side of the shoe mouth P1, but in consideration of the arrangement of FIGS. 28A and 28B, it can be seen that the blowing unit 36 is provided at a side opposite to the shoe with respect to the surface of the shoe mouth portion P1.

By installing the blowing unit 36 on a wall surface adjacent to the heel portion P2 of the shoe, wind is efficiently blown to the toe of the shoe.

(Control Device)

Figure 29:
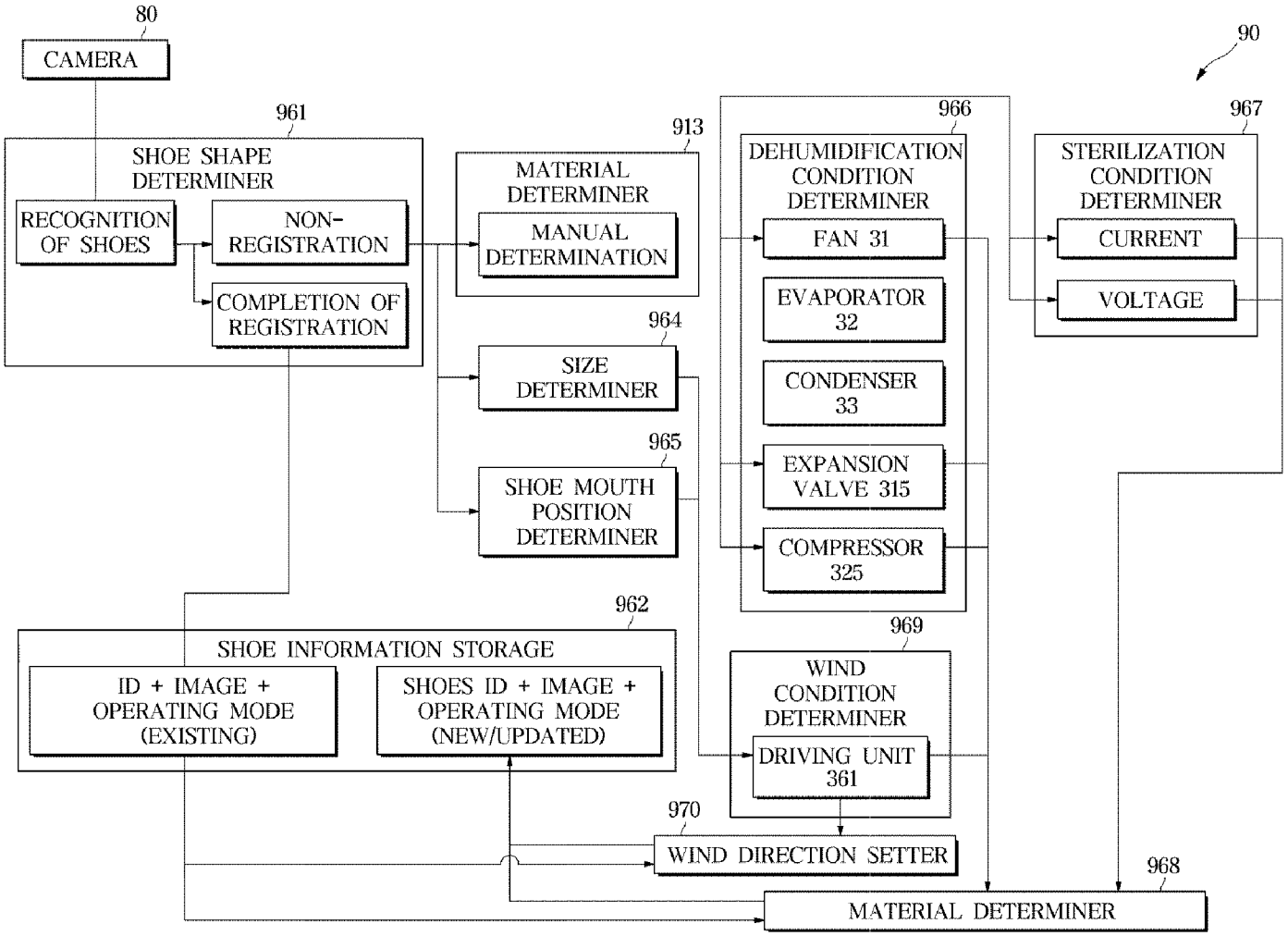
FIG. 29 is a block diagram illustrating an example of a functional configuration for initial control of a control device for the shoe dryer according to the second embodiment of the disclosure.

FIG. 29 is a block diagram illustrating an example of a functional configuration for initial control of the control device 90. As shown in FIG. 29, the control device 90 includes a shoe shape determiner 961, a shoe information storage 962, a material determiner 963, a size determiner 964, a mouth position determiner 965, a dehumidification condition determiner 966, a sterilization condition determiner 967, an operating mode setter 968, a wind direction condition determiner 969, and a wind direction setter 970 as functions for initial control. In addition, the camera 80, which is not a function of the control device 90 in a strict sense, is shown in FIG. 29.

The shoe shape determiner 961 performs shoe recognition of determining whether an image captured by the camera 80 is an image registered in the shoe information storage 962. When the image is not registered in the shoe information storage 962, that is, in response to non-registration, the shoe shape determiner 961 allows a shoe identification (ID), an image, an operating mode, and a wind direction to be automatically stored in the shoe information storage 962 subsequent to determination of the operating mode. In addition, as for shoes that have been previously accommodated in the shoe dryer 2, the shoe ID, the image, the operating mode, and the wind direction are previously registered in the shoe information storage 962, and thus in response to registration, the shoe shape determiner 961 automatically suggests the previously registered operating mode and the wind direction upon the shoe recognition.

The shoe information storage 962 assigns an image with a shoe ID of shoes displayed on the image, and stores the shoe ID to match the image, the operating mode, and wind direction (in the drawing, indicated as "existing"). In addition, in response to non-registration from the shoe recognition, the shoe information storage 962 newly assigns a shoe ID, and stores the image together with an operating mode and wind speed determined for the shoes or in a case when a user updates an operating mode and wind speed, stores the image together with the updated operating mode and wind speed for the shoes (in the drawing, indicated as "New/Updated").

The material determiner 963 is the same as the material determiner 913 according to the first embodiment.

The size determiner 964 extracts and determines size information of the shoe from the image captured by the camera 80.

The mouth position determiner 965 extracts and determines position information of the mouth of the shoe from the image captured by the camera 80.

The dehumidification condition determiner 966, the sterilization condition determiner 967, and the operating mode setter 968 are the same as the dehumidification condition determiner 916, the sterilization condition determiner 917, and the operating mode setter 918 according to the first embodiment.

The wind direction condition determiner 969 determines a suitable driving condition of the driving unit 361 for the blowing nozzle 38 according to the result of determining the size information by the size determiner 964 and the result of determining the mouth position information by the mouth position determiner 965. In the initial operation, the driving condition is determined such that the blowing nozzle 38 is returned to a home position (an initial value) regardless of the determination results, and start operation.

The wind direction setter 970 suggests the conditions determined by the wind direction condition determiner 969 to the user, and sets the wind direction of the blowing nozzle 38 according to a user manipulation responsive to the suggested condition. When the user desires another wind direction and manually updates the wind direction, the wind direction setter 970 sets the updated wind direction and stores the wind direction in the shoe information storage 962. Such a wind direction update in a manual method may be implemented by displaying the wind direction determined by the wind direction condition determiner 969 on the touch panel 18 (see FIG. 14A), and when the user determines that the wind direction is not appropriate, allowing the wind direction to be changed by a touch on the displayed wind direction with a finger.

Figure 30:
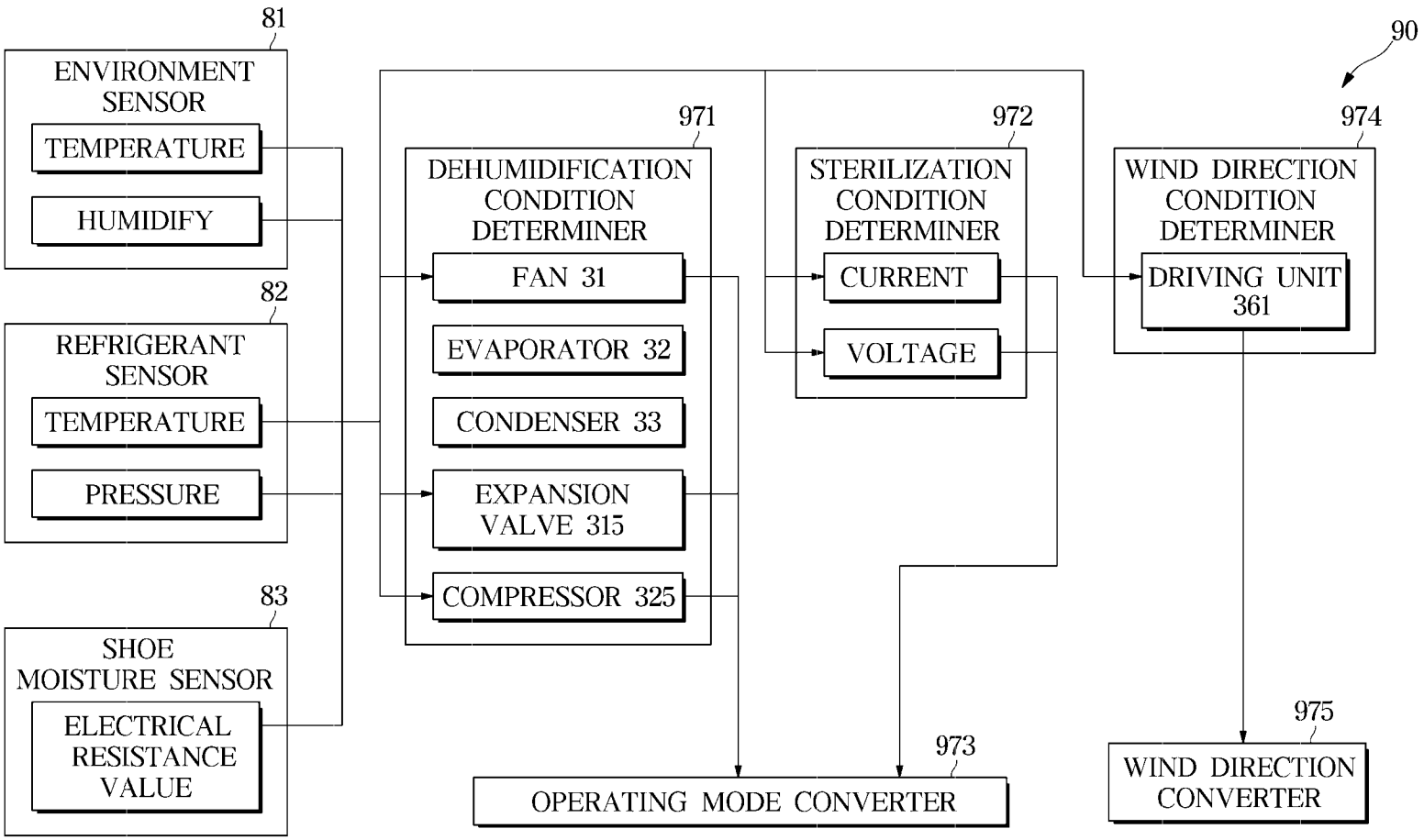
FIG. 30 is a block diagram illustrating an example of a functional configuration for control during operation of the control device of the shoe dryer according to the second embodiment of the disclosure.

FIG. 30 is a block diagram illustrating an example of a functional configuration for control during operation of the control device 90. As shown in FIG. 30, the control device 90 includes a dehumidification condition determiner 971, a sterilization condition determiner 972, an operating mode converter 973, a wind direction condition determiner 974, and a wind direction converter 975 as functions for control during operation. FIG. 30 shows an environmental sensor 81, a refrigerant sensor 82, and a shoe moisture sensor 83, which are not functions of the control device 90 in a strict sense.

The environmental sensor 81, the refrigerant sensor 82, and the shoe moisture sensor 83 are the same as those described in the first embodiment.

The dehumidification condition determiner 971, the sterilization condition determiner 972, and the operating mode converter 973 are the same as the dehumidification condition determiner 921, the sterilization condition determiner 922, and the operating mode converter 923.

The wind direction condition determiner 974 determines a suitable driving condition of the driving unit 361 for the blowing nozzle 38 according to values of the environmental sensor 81, the refrigerant sensor 82, and the shoe moisture sensor 83.

The wind direction converter 975 changes the wind direction of the blowing nozzle 38 according to a condition determined by the wind direction condition determiner 974.

Figure 31:
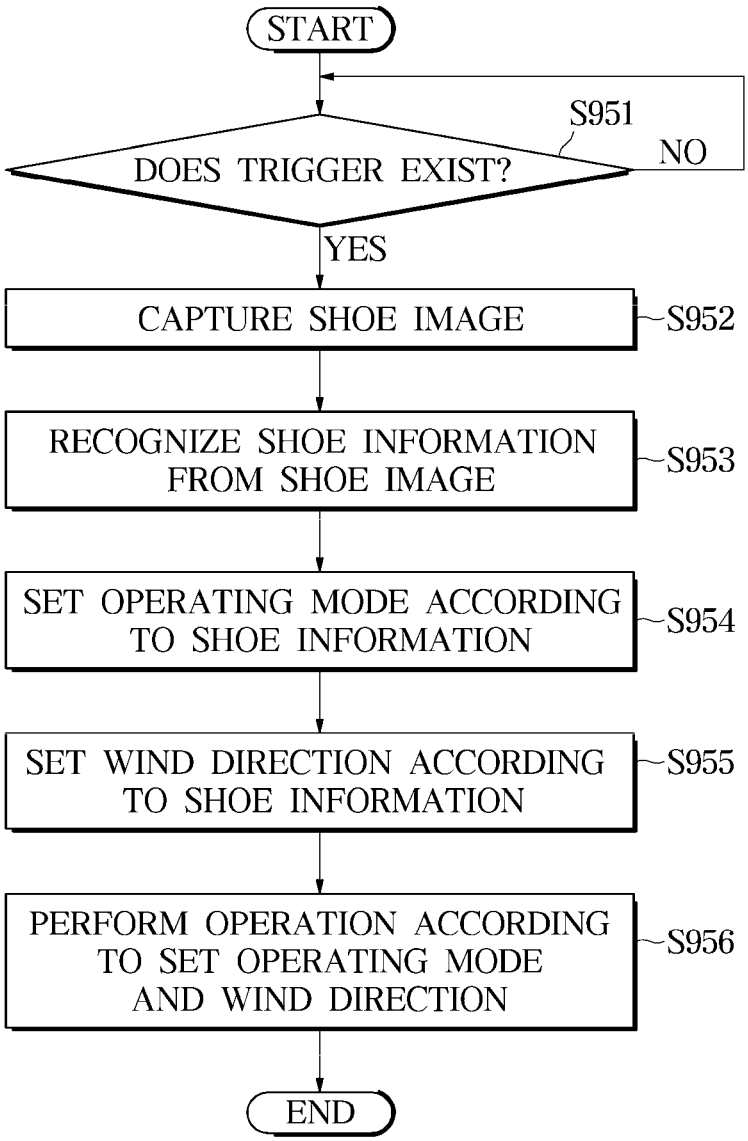
FIG. 31 is a flowchart showing an example of operations of the control device for the shoe dryer according to the second embodiment of the disclosure.

FIG. 31 is a flowchart showing an example of operations of the control device 90. The example of operations is an example of operations at a time of initial control, and the image captured by the camera 80 is a shoe image. In addition, the camera 80 constantly captures the shoe image, and in response to existence of a change between frames of a still image, the control device 90 determines a state change exists and starts the image recognition process as a default. However, when transmission throughput of image data is not sufficient, a central processing unit (CPU) processing image data is powerless, and images are not able to be captured constantly, image capturing may be preferably started by a certain trigger. The following description is made in relation to image capturing that is started by a certain trigger. The following description is made in relation to an example in which image capturing is started by a trigger.

The control device 90 first determines whether a trigger for capturing a shoe image exists (S951). Here, the trigger may include detecting, by a sensor, except for the camera 80, a change of a state representing that a timer has detected the elapse of a certain time (for example, detecting, by a door switch, the door 11 being closed, detecting, by a weight sensor, shoes being accommodated into the partition 21 of the shoe receiving portion 20), and receiving an instruction from a user (for example, receiving an instruction to start an operation after the door 11 is closed). The control device 90 returns to operation S951 in response to determining no trigger, and performs operation S952 in response to determining existence of a trigger.

As such, in response to determining existence of a trigger for capturing a shoe image in operation S951, the control device 90 captures an image of shoes accommodated in the partition 21 of the shoe receiving portion 20 by the camera 80 (S952). Specifically, the control device 90 transmits a signal instructing the camera 80 to capture an image, and the camera 80 captures the shoe image.

Next, the control device 90 recognizes shoe information from the shoe image captured by the camera 80 in operation S952 (S953). Specifically, the shoe shape determiner 961 acquires the shoe image from the camera 80, and recognizes shoe information by, for example, image matching processing. In this case, when the shoe image obtained by the camera 80 is an image stored in the shoe information storage 962, the shoe shape determiner 961 recognizes a shoe ID as the shoe information. On the other hand, when the shoe image acquired from the camera 80 is not stored in the shoe information storage 962, the material determiner 963 recognizes material input by the user as the shoe information. In addition, the size determiner 964 recognizes the size of the shoe as the shoe information. In addition, the mouth position determiner 965 recognizes the mouth position of the shoe as the shoe information.

Subsequently, the control device 90 sets an operating mode according to the shoe information recognized in operation S953 (S954). Specifically, when the shoe image acquired from the camera 80 is an image stored in the shoe information storage 962, the operating mode setter 968 sets the operating mode that is matched with the shoe ID. On the other hand, when the shoe image acquired from the camera 80 is not stored in the shoe information storage 962, the control device 90 determines a humidification condition and a sterilization condition based on definition information defined by the dehumidification condition determiner 966 and the sterilization condition determiner 967 and indicating material recognized by the material determiner 963 and indicating which dehumidification and sterilization conditions are appropriate for which material. Then, the operating mode setter 968 sets the operating mode according to the determined dehumidification condition and sterilization condition.

Subsequently, the control device 90 sets the wind direction according to the size of the shoe and the mouth position among the pieces of shoe information recognized in operation S953 (S955). Specifically, when the shoe image acquired from the camera 80 is stored in the shoe information storage 962, the wind direction setter 970 sets the wind direction matched with the shoe ID. On the other hand, when the shoe image acquired from the camera 80 is not stored in the shoe information storage 962, the wind direction condition determiner 969 determines the driving condition of the driving unit 361 based on the size recognized by the size determiner 964 and the mouth position recognized by the mouth position determiner 965. Then, the wind direction setter 970 sets the wind direction according to the determined driving condition.

Finally, the control device 90 performs operation on the shoe dryer 2 according to the operating mode set in operation S954 and the wind direction of the blowing nozzle 38 set in operation S955 (S956). Specifically, the control device 90 transmits, to each component of the shoe dryer 2, a signal instructing the operation in the set operating mode, while transmitting, to the driving unit 361 of the blowing unit 36, a signal for driving the blowing nozzle 38 to blow air in the set wind direction.

Here, in operations S954 and S955, the operating mode and the wind direction according to the shoe information recognized from the shoe image are set, and the shoe dryer 2 is operated with the operating mode and the blowing nozzle 38-2 is operated to blow air with the set wind direction, but this is only an example. Any processing may be performed using the shoe information recognized from the shoe image.

As is apparent from the above, a shoe can be prevented from being insufficiently or excessively dried due to air blowing in the same direction regardless of the position of a mouth portion of the shoe.

Although the present disclosure has been described with various embodiments, various changes and modifications may be suggested to one skilled in the art. It is intended that the present disclosure encompass such changes and modifications as fall within the scope of the appended claims.

What is claimed is:

1. A shoe dryer comprising:

a main body;

a shoe receiver provided inside the main body and configured to receive a shoe;

a blower configured to blow air toward the shoe received in the shoe receiver;

a camera configured to obtain an image of the shoe by photographing the shoe received in the shoe receiver; and a control device configured to recognize information about the shoe from the image of the shoe obtained by the camera and control a direction of air blown by the blower based on the information about the shoe.

2. The shoe dryer of claim 1, wherein:

the information about the shoe includes position information of a mouth portion of the shoe, and the control device controls the direction of air blown by the blower to face toward a center of the mouth portion of the shoe.

3. The shoe dryer of claim 2, wherein the center of the mouth portion of the shoe is a center of a circle or an ellipse that is approximated to a shape of an upper surface of the mouth portion of the shoe.

4. The shoe dryer of claim 1, wherein:

the blower includes a blowing nozzle, and the blowing nozzle is provided to be rotatable.

5. The shoe dryer of claim 4, wherein the blowing nozzle includes a guide plate formed adjacent to a center of a flow path of the blowing nozzle and is configured to guide an air current.

6. The shoe dryer of claim 4, wherein the blowing nozzle includes an opening/closing mechanism formed at a suction port or a discharge port of the blowing nozzle and is configured to open and close a flow path of the suction port or the discharge port.

7. The shoe dryer of claim 4, wherein the blower further includes an extension nozzle coupled to the blowing nozzle and is extended into the shoe received in the shoe receiver.

8. The shoe dryer of claim 4, further comprising a driving unit configured to rotate the blowing nozzle to adjust a direction of discharged air from the blowing nozzle.

9. The shoe dryer of claim 8, wherein the driving unit includes a motor that configured to determine an amount of movement of the blowing nozzle based on a driving power waveform.

10. The shoe dryer of claim 4, wherein:

the blowing nozzle includes a plurality of blowing nozzles, and the plurality of blowing nozzles include a first blowing nozzle configured to blow air toward a right shoe and a second blowing nozzle configured to blow air toward a left shoe.

11. The shoe dryer of claim 10, wherein the first blowing nozzle has a direction controlled independent of a direction of the second blowing nozzle.

12. The shoe dryer of claim 1, wherein:

the shoe receiver includes a first shoe receiver having a first partition to receive one pair of shoes and a second shoe receiver provided below the first shoe receiver and having a second partition to receive another pair of shoes, and the first partition is detachably provided.

13. The shoe dryer of claim 1, further comprising an accessary receiver provided inside the main body and configured to receive a shoe accessary.

14. The shoe dryer of claim 1, further comprising:

a manipulation portion configured to display the information about the shoe; and a display element indicating a direction in which air is blown by the blower, the display element configured to perform manipulation on the display element using a finger or speech.

15. A method of controlling a shoe dryer including a shoe receiver configured to receive a shoe, and a blower configured to blow air toward the shoe received in the shoe receiver, the method comprising:

acquiring an image of the shoe received in the shoe receiver by photographing the shoe;

recognizing information about the shoe from the acquired image of the shoe; and controlling a direction of air blown by the blower based on the information about the shoe.

16. The method of claim 15, wherein:

the recognized information about the shoe includes position information of a mouth portion of the shoe, and the direction of air blown by the blower is controlled to face toward a center of the mouth portion of the shoe.

17. The method of claim 16, wherein the center of the mouth portion of the shoe is a center of a circle or an ellipse that is approximated to a shape of an upper surface of the mouth portion of the shoe.

18. The method of claim 15, further comprising determining an existence of a trigger to image the shoe.

19. The method of claim 15, further comprising setting an operating mode according to the recognized information about the shoe.

20. The method of claim 19, wherein the operating mode includes at least one of a temperature of air blown by the blower, a wind volume of air blown by the blower, a wind speed of air blown by the blower, and an operating time of the shoe dryer.

* * * * *